US006176564B1

(12) United States Patent
Katayama

(10) Patent No.: US 6,176,564 B1
(45) Date of Patent: Jan. 23, 2001

(54) INK JET RECORDING APPARATUS

(75) Inventor: Yoshiki Katayama, Nagoya (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 08/998,870

(22) Filed: Dec. 29, 1997

(30) Foreign Application Priority Data

Dec. 28, 1996 (JP) ..... 8-358514

(51) Int. Cl.[7] ..... B41J 2/165
(52) U.S. Cl. ..... 347/23
(58) Field of Search ..... 347/22, 23

(56) References Cited

U.S. PATENT DOCUMENTS 4,543,591 9/1985 Terasawa .
5,341,163 * 8/1994 Hanabusa ..... 347/23

FOREIGN PATENT DOCUMENTS 3-234543 * 10/1991 (JP) ..... 347/23
3-234544 * 10/1991 (JP) ..... 347/23
4-148937 * 5/1992 (JP) ..... 347/23
4-148939 * 5/1992 (JP) ..... 347/23

* cited by examiner

*Primary Examiner*—Huan Tran
(74) *Attorney, Agent, or Firm*—Oliff & Berridge, PLC

(57) ABSTRACT

An ink jet recording apparatus has a recording head for recording by ejecting ink onto a recording medium, a head recovery device that recovers a function of the recording head, a suction switch for operating the head recovery device, and a print instruction switch, and an inhibition device that inhibits operation of the head recovery device under a predetermined condition. When operation of the head recovery device is inhibited under a certain condition, the head recovery device cannot be operated if the suction switch is operated. The inhibition of head recovery operation is canceled when the suction switch and a print instruction switch are operated. The recording apparatus thereby prevents unintentional head recovery operation and prevents unnecessary ink consumption, without degrading the operability of the head recovery device.

43 Claims, 23 Drawing Sheets

INK JET RECORDING APPARATUS

BACKGROUND OF THE INVENTION

1. Field of Invention

The invention relates to an ink jet recording apparatus having an ink jet recording head for recording by ejecting ink onto a recording medium, and a recovery device for recovering the function of the recording head.

2. Description of Related Art

In conventional ink jet recording apparatuses for recording by ejecting ink from nozzles, it is necessary to place a cap on an ink jet head when not in use because ink on a nozzle surface is likely to dry and solidify causing an ink ejection failure. In order to recover from an ink ejection failure or prevent an ink ejection failure, there is a need to perform maintenance of an ink jet head. There are several maintenance methods for ink jet heads, for example, a purging method in which nozzle clogging is eliminated by, for example, drawing dry ink from an ink jet head nozzle, or a wiping method in which an ink-wet nozzle surface is wiped. As a device for facilitating such an ink jet head maintenance operation, U.S. Pat. No. 4,543,591 discloses a maintenance device for an ink jet recording apparatus, which immediately performs the capping of a nozzle and the subsequent ink drawing at freely selectable timings by operation of a lever in one direction.

However, if the aforementioned maintenance device is incorporated into a head recovery device, the operability improves, but unnecessary ink consumption may result through improper operation.

SUMMARY OF THE INVENTION

Accordingly, it is an object of the invention to provide an ink jet recording apparatus that prevents improper operation of a head recovery device and, thereby, eliminates unnecessary ink consumption, without degrading operability.

To achieve the aforementioned object, the invention provides an ink jet recording apparatus including a recording head for recording by ejecting ink onto a recording medium, a head recovery device that recovers a function of the recording head, a first switch for operating the head recovery device, and an inhibition device that inhibits operation of the head recovery device under a predetermined condition.

Because the inhibition device inhibits operation of the head recovery device under a predetermined condition, unintentional or accidental operation of the head recovery device can be prevented even if the switch for operating the head recovery device is operated in such an occasion. Therefore, unnecessary ink consumption is prevented.

The inhibition device may have a second switch provided aside from the first switch, and the inhibition device cancels the inhibition of operation of the head recovery device when the first switch and the second switch are operated.

The inhibition device may cancel the inhibition of operation of the head recovery device when the first switch is continually operated.

The inhibition device may have a timer for measuring time elapsed after a previous operation of the head recovery device, and the inhibition device cancels the inhibition of operation of the head recovery device when the time measured by the timer reaches a predetermined length of time.

The inhibition device may have a timer for measuring time elapsed after a previous operation of the recording head, and the inhibition device cancels the inhibition of operation of the head recovery device when the time measured by the timer reaches a predetermined length of time.

The inhibition device may have a timer for measuring time elapsed after a main switch of the ink jet recording apparatus is turned on, and the inhibition device cancels the inhibition of operation of the head recovery device when the time measured by the timer reaches a predetermined length of time.

The inhibition device may have a counter for counting an amount of printed characters that are printed by the recording head after a previous operation of the head recovery device, and the inhibition device cancels the inhibition of operation of the head recovery device when the count by the counter reaches a predetermined value.

The inhibition device may have a sensor for counting an amount of ink that is used by the recording head after a previous operation of the head recovery device, and the inhibition device cancels the inhibition of operation of the head recovery device when the count provided by the sensor reaches a predetermined amount.

The inhibition device may have a counter for counting a number of times that the recording head prints after a previous operation of the head recovery device, and wherein the inhibition device cancels the inhibition of operation of the head recovery device when the count by the counter reaches a predetermined value.

The inhibition device may have a counter for counting an amount of printed characters that are printed by the recording head after a main switch of the ink jet recording apparatus is turned on, and the inhibition device cancels the inhibition of operation of the head recovery device when the count by the counter reaches a predetermined amount.

The inhibition device may have a counter for counting an amount of ink that is used by the recording head after a main switch of the ink jet recording apparatus is turned on, and the inhibition device cancels the inhibition of operation of the head recovery device when the count by the counter reaches a predetermined amount.

The inhibition device may have a counter for counting a number of times that the recording head prints after a main switch of the ink jet recording apparatus is turned on, and the inhibition device cancels the inhibition of operation of the head recovery device when the count by the counter reaches a predetermined value.

The inhibition device may have a sensor for measuring an amount of ink remaining in the recording apparatus, and the inhibition device prevents cancellation of the inhibition of operation of the head recovery device when the amount measured by the sensor has become equal to or lower than a predetermined amount. With this structure, when the ink remaining in the recording apparatus has become equal to or less than the predetermined amount, it becomes impossible to operate the recovery device. This structure eliminates an inconvenient incident wherein the recovery device is operated when there is only a small amount of ink remaining, so that the remaining ink is completely consumed. That is, even when there is only a little ink left, it is possible to continue recording while preventing the recovery device from operating, even though minor problems occur in recording quality.

The inhibition device may have a second counter for counting a number of operations of the recovery device, and the inhibition device prevents cancellation of the inhibition of operation of the head recovery device when the count by the second counter has reached a predetermined value. With this structure, when the number of operations of the recovery device has reached the predetermined number, it becomes impossible to operate the recovery device. This structure prevents an unnecessarily great number of recovery operations and, therefore, prevents unnecessary ink consumption.

The ink jet recording apparatus may further include a recovery permission device that forcibly cancels a condition setting for the inhibition by the inhibition device. This structure allows the head recovery device to be driven even under the inhibition condition, if a recovery operation is needed.

The ink jet recording apparatus may further have an inhibition condition setting device that enables selection of whether to set a condition for the inhibition by the inhibition device. This structure makes it possible for a user to select a condition for the inhibition in accordance with the working conditions, thereby improving usability and reducing unnecessary ink consumption.

The ink jet recording apparatus may be a small-size manually-driven printing apparatus that records by ejecting ink onto a recording medium when the apparatus is manually moved over the recording medium.

BRIEF DESCRIPTION OF THE DRAWINGS

Preferred embodiments of the invention will be described in detail with reference to the following figures wherein.

DETAILED DESCRIPTION OF PREFERRED EMBODIMENTS

Preferred embodiments of the invention will be described in detail hereinafter with reference to the accompanying drawings.

Figure 1:
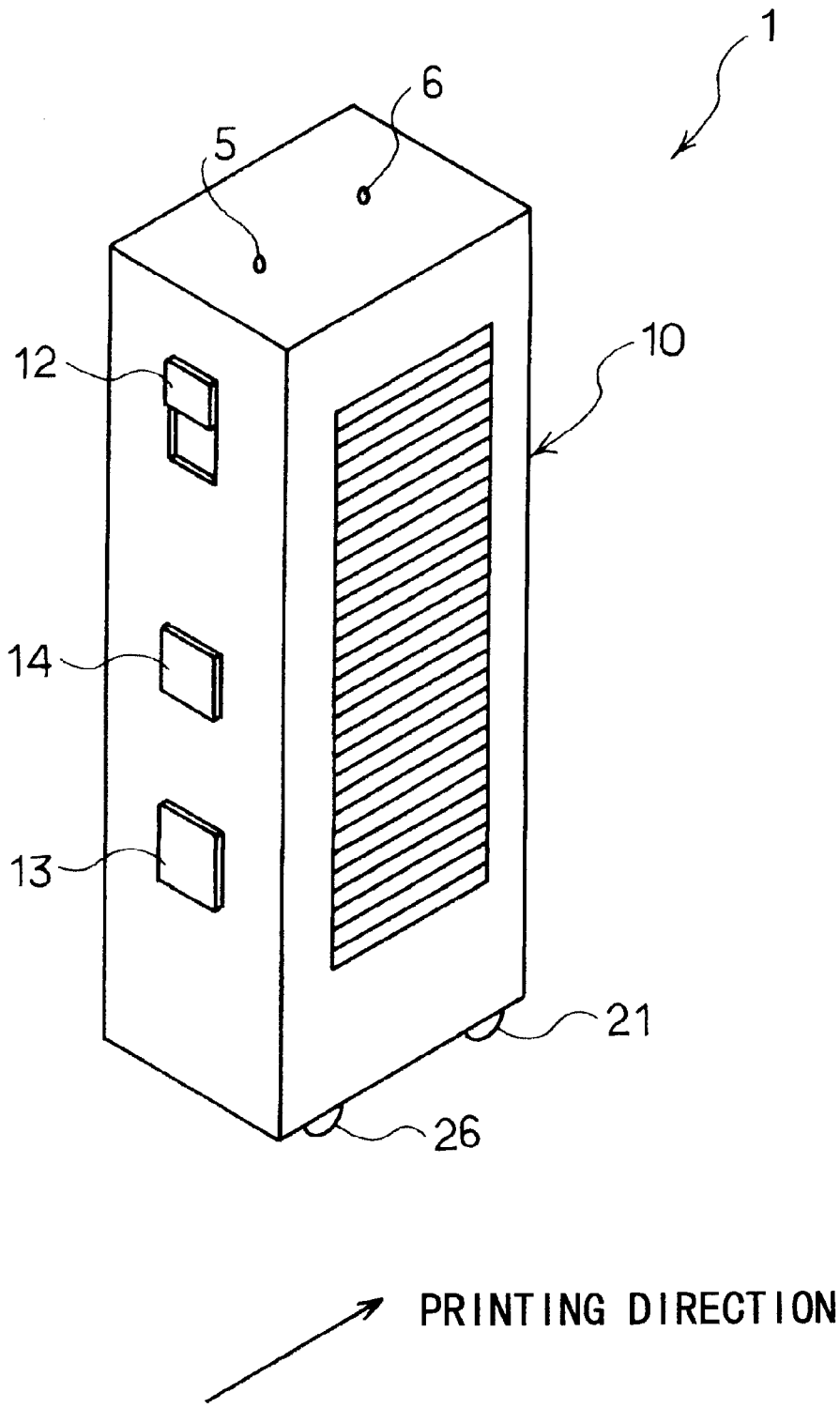
FIG. 1 is an exterior view of a manually-driven printing apparatus according to an embodiment of the invention.
Figure 2:
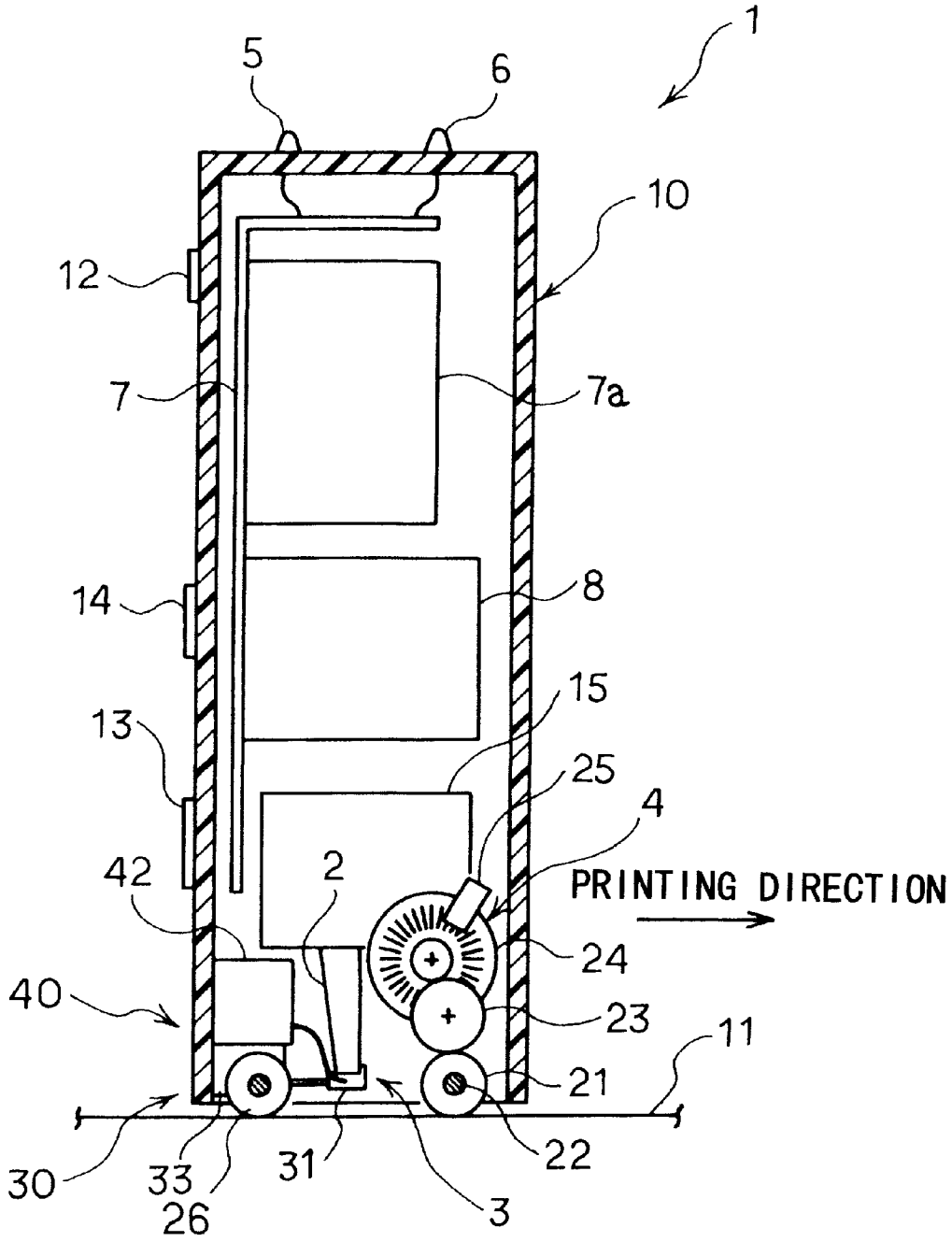
FIG. 2 is a sectional view of the manually-driven printing apparatus shown in FIG. 1.
Figure 3:
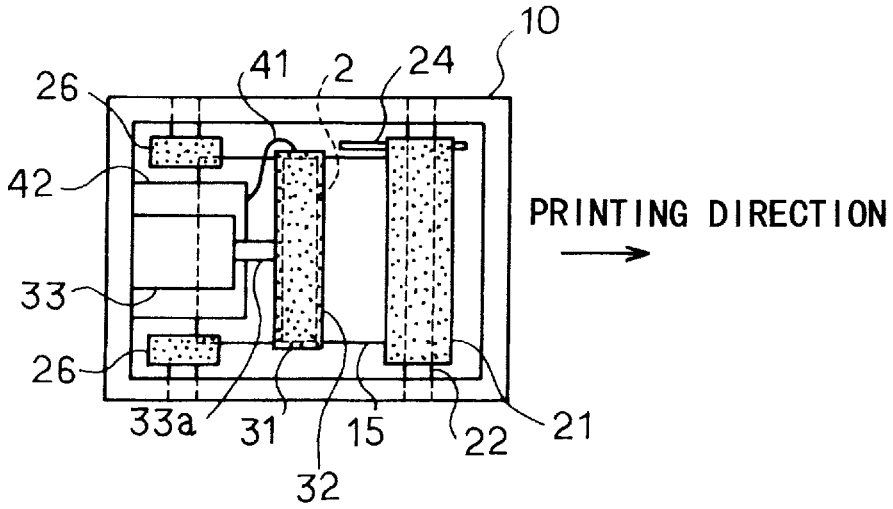
FIG. 3 is a bottom view of the manually-driven printing apparatus shown in FIG. 1.

A manually-driven printing apparatus according to a preferred embodiment of the invention will first be described. FIG. 1 is an exterior view, FIG. 2 is a sectional view, and FIG. 3 is a bottom view of a manually-driven printing apparatus 1. The manually-driven recording apparatus 1 includes a recording mechanism 3 having an ink jet recording head 2, a displacement detecting mechanism 4 for detecting the amount of movement of the recording apparatus 1, an infrared photo-diode 5 and an infrared-emitting diode 6 for infrared communications with an external device, a control circuit board 7 carrying a control portion 7*a* for controlling the recording mechanism 3, and a battery 8 which is a secondary battery, i.e., a rechargeable power source, and the like. The control portion 7*a* controls the transmission and reception of the diodes 5, 6, and controls the driving of the recording mechanism 3 on the basis of an encoder signal from the displacement detecting mechanism 4. The aforementioned components are electrically connected and compactly housed in a body case 10. The manually-driven recording apparatus 1 is capable of recording characters and graphic images on a recording sheet (recording medium) 11 by manually moving the recording apparatus 1 on the recording sheet 11 in a printing direction.

The body case 10 is a synthetic resin-made case having the shape of a hollow prism with a bottom opening. When viewed two-dimensionally, the body case 10 has a generally rectangular shape. The infrared photo-diode 5 and the infrared-emitting diode 6 are disposed in an upper end wall of the body case 10. Disposed in a front wall, i.e., the wall on the rear of the body case 10 relative to the printing direction, of the body case 10 are a power switch 12, a print instruction switch 13 for instructing permission and inhibition of a recording operation, and a suction switch 14 for operating a suction mechanism (described later) which is a head recovery device. The suction switch 14 constitutes a first switch for operating the head recovery device. The print instruction switch 13 constitutes a second switch for canceling the inhibition of operation of the head recovery device.

The recording mechanism 3 will now be described in detail. An ink tank 15 containing an ink absorbent impregnated with a recording ink is detachably disposed in a lower end portion of the body case 10. The ink tank 15 is connected to the recording head 2. The recording head 2 has, for example, two rows of downward-directed ejection nozzles (not shown) that extend in a transverse direction perpendicular to the recording direction. Each row includes, for example, thirty-two ejection nozzles. Ink is supplied from the ink tank 15 to each ejection nozzle of the recording head 2, and ink droplets are ejected selectively from ejection nozzles to the recording sheet 11 placed below.

The displacement detecting mechanism 4 is designed to detect the amount of movement of the manually-driven recording apparatus 1 relative to the recording sheet 11. A timing roller 21 made of rubber, extending close to the recording head 2 in the transverse direction is rotatably supported by a journal shaft 22 to a lower end portion of the body case 10. A gear 23, in contact with a portion of the timing roller 21, is rotatably journaled to the body case 10. A circular encoder plate 24 rotatable by the gear 23 is rotatably journaled to the body case 10. A plurality of slits are formed in an outer peripheral portion of the encoder plate 24. A photo-sensor 25 having a light-emitting portion and a light-receiving portion is disposed so that the light-emitting portion and the light-receiving portion respectively face opposite surfaces of the outer peripheral portion of the encoder plate 24. A pair of auxiliary rollers 26 are rotatably journaled to a lower end portion of the body case 10. Lower end portions of the timing roller 21 and the auxiliary rollers 26 protrude from the lower end of the body case 10. As the body case 10 is manually moved in the recording direction while the timing roller 21 is in contact with the recording sheet 11, the timing roller 21 rotates in a predetermined direction (clockwise in FIG. 2) and, simultaneously, the encoder plate 24 is rotated by the gear 23, so that the photo-sensor 25 outputs an encoder signal composed of a pulse train (that is, a signal indicating the amount of movement). Based on the encoder signal and recording data, ink is selectively ejected from ejection nozzles at each recording timing at intervals corresponding to a movement of the body case 10 of a predetermined number of recording pitches, thereby recording characters and graphic images on the recording sheet 11.

Figure 4:
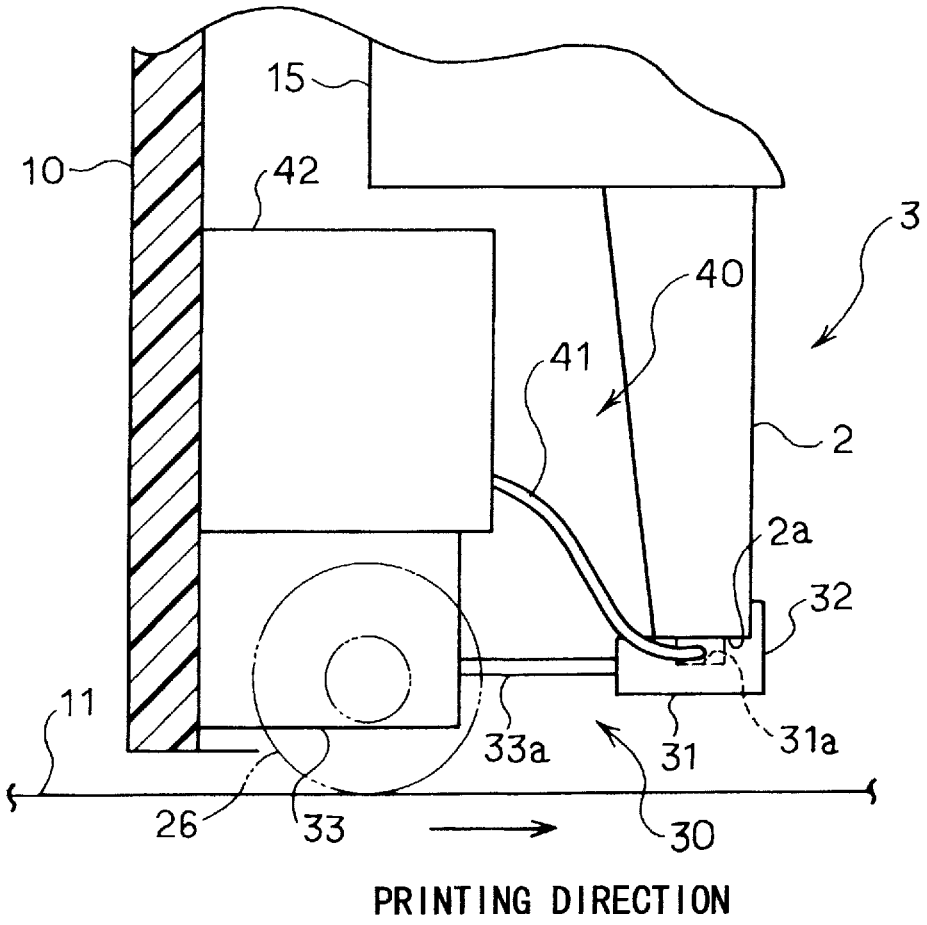
FIG. 4 is a fragmental sectional view of the manually-driven printing apparatus, with a cap member being at a capping position.
Figure 5:
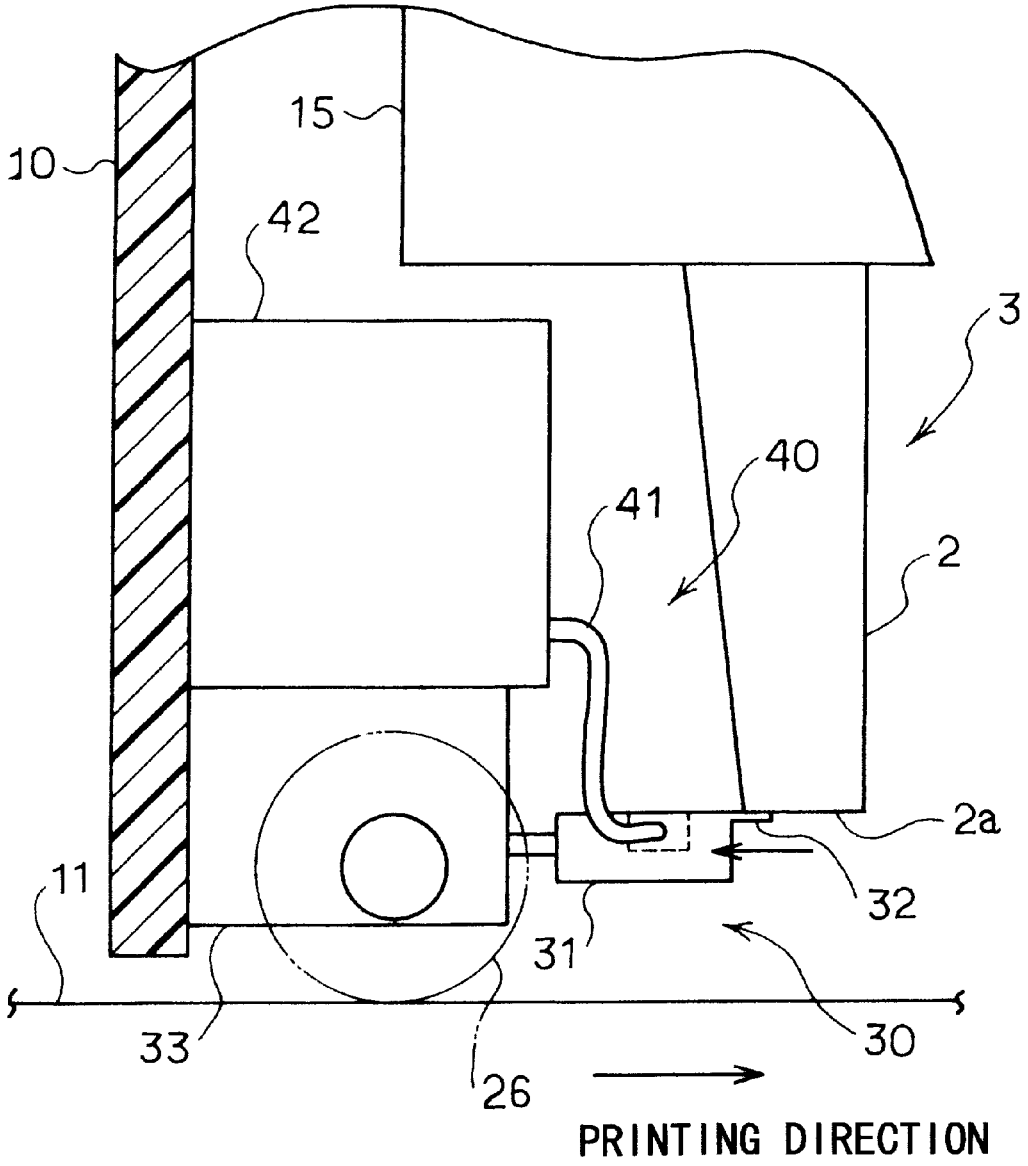
FIG. 5 is a fragmental sectional view of the manually-driven printing apparatus, with the cap member being at a withdrawn position.

A cap member 31 capable of tightly contacting a head surface 2*a* of the recording head 2, and a cap drive mechanism 30 for driving the cap member 31, will be described with reference to FIGS. 4 and 5 as well. In FIG. 4, the cap member 31 is at a capping position. In FIG. 5, the cap member 31 is at a withdrawn position. The cap member 31 is formed of an elastic rubber, and has a block shape that is slightly larger than the head surface 2*a* (lower end surface) of the recording head 2. The cap member 31 has a transversely long suction recess 31*a* corresponding to the ejection nozzle array disposed in the recording head 2. A wiper blade 32, extending in the transverse direction and having a predetermined height, is provided integrally with an end portion of the cap member 31, the end being in the printing direction. The wiper blade 32 is formed of the same elastic rubber as the cap member 31. The wiper blade 32 has a certain elasticity and is deformable.

A position switching solenoid 33 for driving the cap member 31 is disposed on a lower end portion of the body case 10. A distal end of a plunger 33*a* of the position switching solenoid 33 is connected to the cap member 31. When recording is not performed, the position switching solenoid 33 remains undriven so that the plunger 33*a* is in a projected position. Therefore, the cap member 31 remains in tight contact with the downward-facing head surface 2*a* of the recording head 2, as shown in FIG. 4. When recording is to be performed, the position switching solenoid 33 is driven so that the plunger 33*a* is withdrawn as shown in FIG. 5. Therefore, the cap member 31 is horizontally moved, sliding on the head surface 2*a*, in a direction opposite to the recording direction. The cap member 31 is thus switched to the withdrawn position. While the cap member 31 is being moved to the withdrawn position, the wiper blade 32 thoroughly wipes unnecessary ink from the head surface 2*a*, that is, the ejection nozzle surface. When the driving of the position switching solenoid 33 is discontinued, the plunger 33*a* is projected or thrust out so that the cap member 31 is moved back to the capping position sliding on the head surface 2*a*.

A suction mechanism (a head recovery device) 40 for sucking the ejection nozzles of the recording head 2 will now be described in detail. An end of a suction tube 41 is connected to a side surface of the suction recess 31*a* of the cap member 31. The other end of the suction tube 41 is connected to a suction pump 42 disposed on the body case 10. The suction pump 42 is designed to produce a negative pressure for suction by using a cam body that is rotated by a small-size motor driven by the battery 8. Due to the negative pressure, the ejection nozzles are sucked via the suction recess 31*a* and the suction tube 41.

Figure 6:
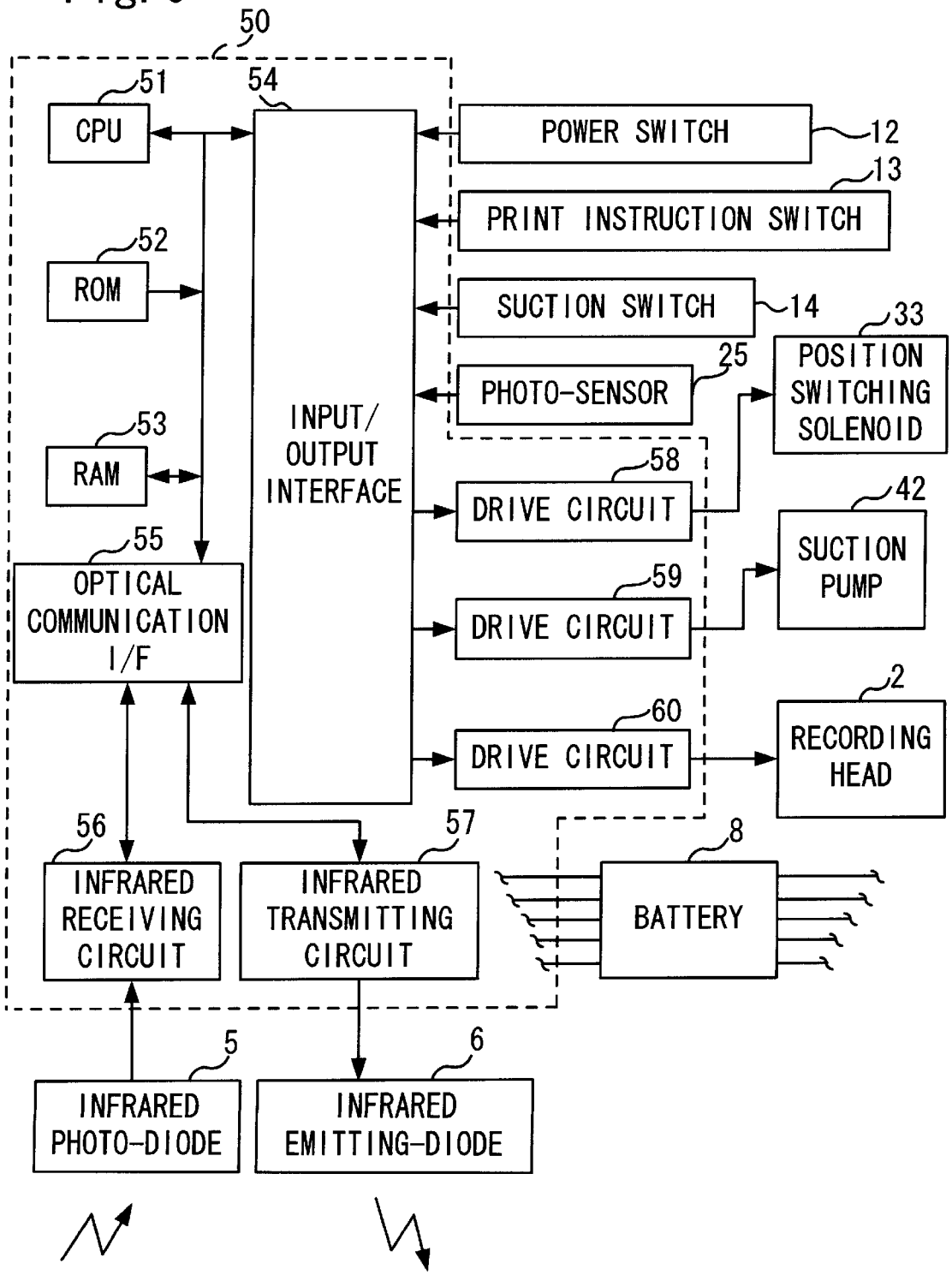
FIG. 6 is a block diagram of a control system of a recording apparatus according to a first embodiment.

A control system provided in the control portion 7*a* for controlling the manually-driven recording apparatus 1 is structured as schematically shown in the block diagram of FIG. 6. A control device 50 includes a microprocessor that has a CPU 51, a ROM 52, a RAM 53 and an input/output interface 54. The control device 50 further includes an optical communication interface 55, an infrared-receiving circuit 56 and an infrared-transmitting circuit 57 for communication by infrared light with an external electronic device (not shown), such as a personal computer, and further includes drive circuits 58–60, and the like. The input/output interface 54 is connected to the power switch 12, the print instruction switch 13, the suction switch 14, the photo-sensor 25, a drive circuit 58 for the position switching solenoid 33, a drive circuit 59 for the suction pump 42, and a drive circuit 60 for the recording head 2. The infrared-receiving circuit 56 is connected to the infrared photo-diode 5, and the infrared-transmitting circuit 57 is connected to the infrared-emitting diode 6. The infrared-receiving circuit 56 receives optical data transmitted from an external electronic device by infrared, via the infrared photo-diode 5. The infrared-transmitting circuit 57 transmits, to the external electronic device, recording format data regarding character sizes or fonts and various data regarding data transfer, in the form of optical data, via the infrared-emitting diode 6.

The ROM 52 stores a recording control program for drive-controlling an actuator provided for each ejection nozzle of the recording head 2, a control program for optical data transmission and reception, a control program for recording control (described below), dot pattern data regarding individual characters and symbols, and the like. The RAM 53 includes a data memory for storing optical data received, and various memories needed for recording control or optical communication control and the like.

Figure 7:
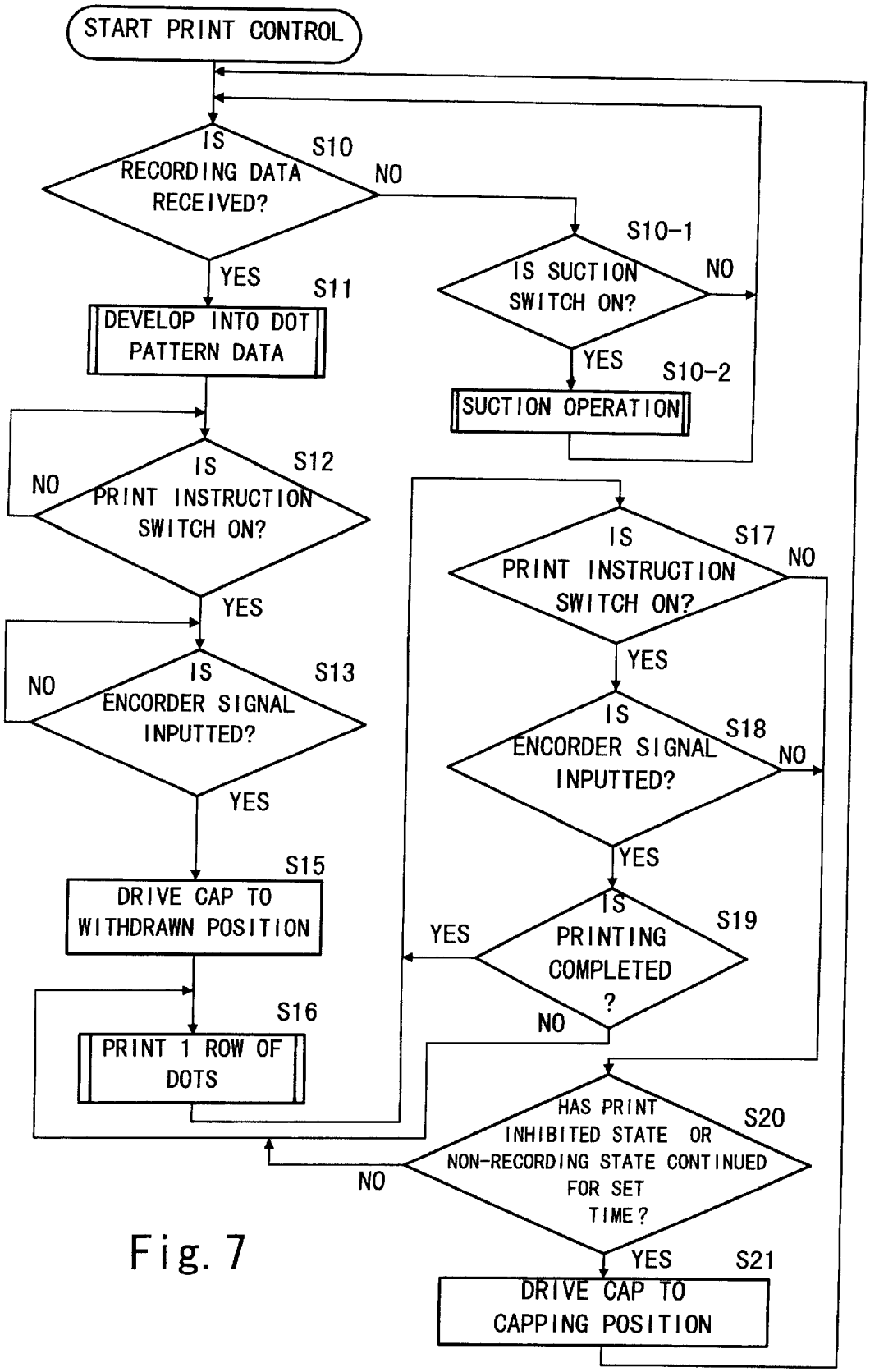
FIG. 7 is a flowchart of a printing control of the recording apparatus.

A print control routine executed by the control device 50 of the manually-driven recording apparatus 1 will be described with reference to the flowchart of FIG. 7, in which Si (i=10, 11, 12, . . . ) indicates individual steps. When the power switch 12 of the recording apparatus 1 is turned on, this control routine is started. The control device 50 waits until recording data is received via the infrared photo-diode 5 (No in step S10). If recording data has been received (Yes in step S10), the control device 50 performs data development into dot pattern data (step S11). If recording data composed of a plurality of code data is received, a plurality of code data for recording individual lines are separately developed into dot pattern data. Until the print instruction switch 13 is turned on, the control device 50 remains in a recording standby state (No in step S12)

The body case 10 is manually held in a substantially vertical upstanding position so that the timing roller 21 is in contact with the recording sheet 11. Then, the print instruction switch 13 is turned on for recording (Yes in step S12). The body case 10 is then manually moved linearly in the printing direction while the print instruction switch 13 is held in the on-position. As the encoder plate 24 is rotated by rotation of the timing roller 21, the encoder signal outputted from the photo-sensor 25 is inputted to the control device 10 (Yes in S13). The position switching solenoid 33 is then driven so that the cap member 31 is moved from the capping position (FIG. 4) to the withdrawn position (FIG. 5), sliding on the head surface 2*a* (S15). While the cap member 31 is being moved to the withdrawn position, the wiper blade 32 thoroughly wipes unnecessary ink from the head surface 2*a,* that is, the ejection nozzle surface. Based on the recording data for one row of dots, the control device 50 performs recording of the dot row (S16), by driving the corresponding ejection nozzles to eject ink. Subsequently, if the print instruction switch 13 is on (Yes in step S17) and the encoder signal is inputted, that is, the manually-driven movement of the body case 10 continues (Yes in step S18), it is then determined in step S19 whether the recording is completed. If recording is not completed (No in step S19), the operation of steps S16–S19 is repeated to performing recording of one dot row at a time.

When recording of a line is completed (Yes in step S19), the operation of steps S17–S19 is repeated. When the body case 10 is stopped, input of the encoder signal discontinues (No in step S18). If the non-recording state continues for a predetermined length of time (for example, 2 to 3 seconds) (Yes in step S20), the driving of the position switching solenoid 33 is stopped so that the cap member 31 is moved from the withdrawn position to the capping position (FIG. 4), sliding on the head surface 2*a* (S21). Since the cap member 31 is thus switched between the capping position and the withdrawn position in cooperation with the recording operation so that the cap member 31 is at the capping position when recording is not performed, ink on the head surface 2*a* is protected from drying. If recording of a line is completed (Yes in S19) and then the print instruction switch 13 is turned off so that recording inhibition is instructed (No in step S17), it is determined in step S20 whether the recording inhibited state has continued for a predetermined length of time. If the recording inhibited state has continued for the predetermined length of time (Yes in step 20), the cap member 31 is moved to the capping position (S21). If the body case 10 is temporarily stopped during a recording operation, the determination in step S18 is NO, and the operation proceeds to step S20. If the print instruction switch 13 is temporarily turned off, the determination in step S17 is NO, and the operation proceeds to step S20. If it is subsequently determined in step S20 that the recording inhibited state has not continued for the predetermined length of time, the operation starting at step S16 is repeated to continue recording.

If it is determined in step S10 that recording data is not received, the control device 50 checks whether the suction switch 14 is turned on (S10-1). If the suction switch 14 is turned on (Yes in step S10-1), the control device 50 starts a suction operation by the suction mechanism 40 (S10-2). After that, the operation returns to step S10.

Figure 8:
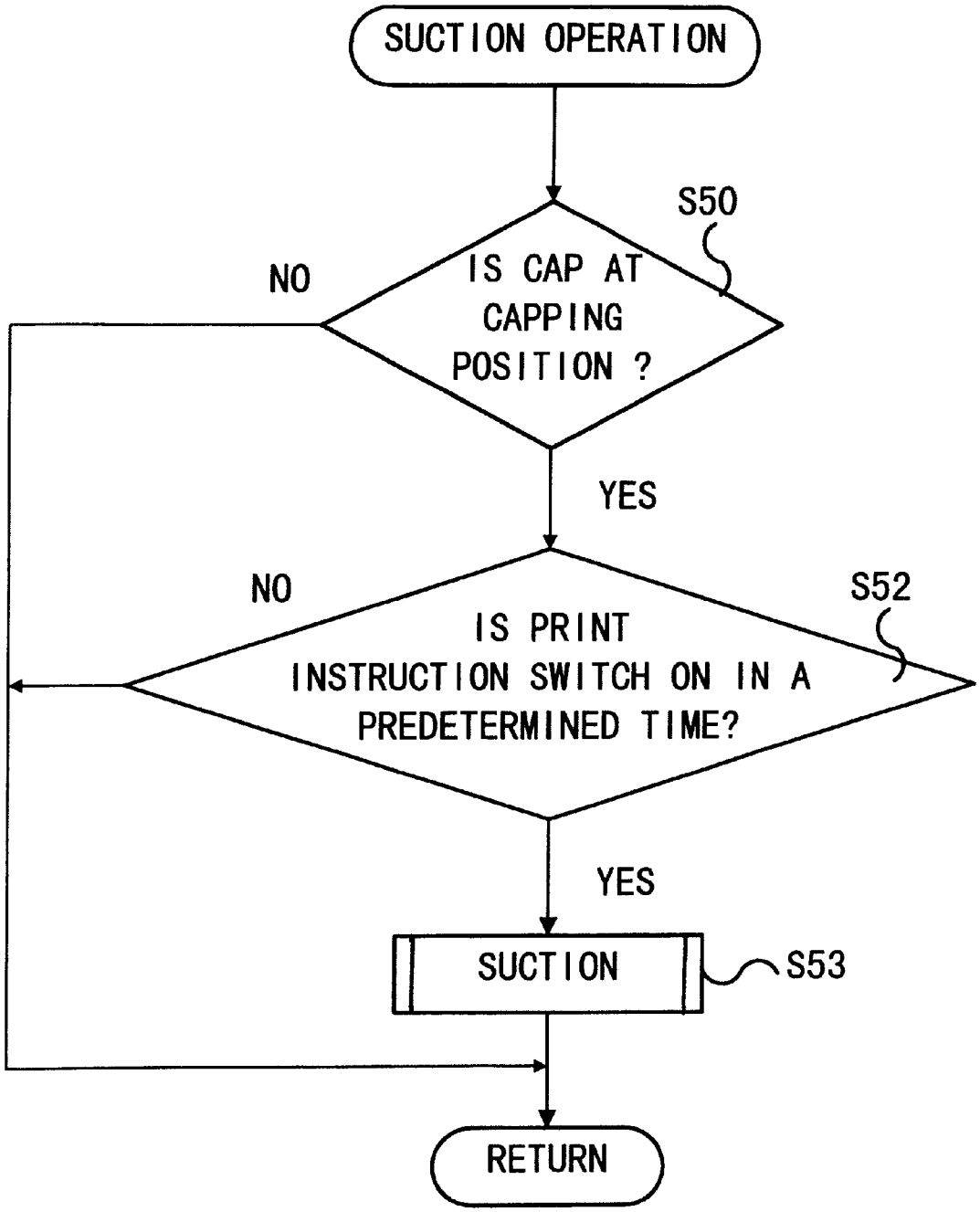
FIG. 8 is a flowchart of a subroutine for suction operation by a suction mechanism according to the first embodiment.

FIG. 8 illustrates the suction operation subroutine. When this routine is started, it is determined in step S50 whether the cap member 31 is at the capping position relative to the recording head 2. If the cap member 31 is at the capping position (Yes in step S50), it is determined in step S52 whether the print instruction switch 13 has been turned on within a predetermined time, for example, 10 sec., after the suction switch 14 is turned on. If the print instruction switch 13 is on (Yes in step S52), the suction pump 42 is driven for a predetermined length of time (for example, 1 to 2 seconds) to perform suction of the ejection nozzles via the cap member 31 in step S53. That is, only when both the suction switch 14 and the print instruction switch 13 are on, operation of the suction mechanism 40 is manually instructed, thereby preventing unintentional or accidental suction operation. Thus, the print instruction switch 13, and the control device 50 constitute an inhibition device for inhibiting operation of the head recovery device under a predetermined condition. The number of such switches may be more than two. The switches are not limited to electrical switches but may be mechanical switches.

The invention is not limited to the foregoing embodiment, but may be modified in various ways. For example, although the embodiment employs two switches as a device for inhibiting operation of the head recovery device and canceling the inhibition, devices other than two switches may be employed as in an embodiment described below.

A second embodiment will be described with reference to FIGS. 7 and 9. Referring first to the flowchart of FIG. 7, when print control is started, it is determined in step S10 whether recording data is received. If recording data is not received, it is checked in step S10-1 whether the suction switch 14 is on. If it is determined that the suction switch 14 is on (Yes in step S10-1), the control device 50 starts suction operation by the suction mechanism 40 in step S10-2.

Figure 9:
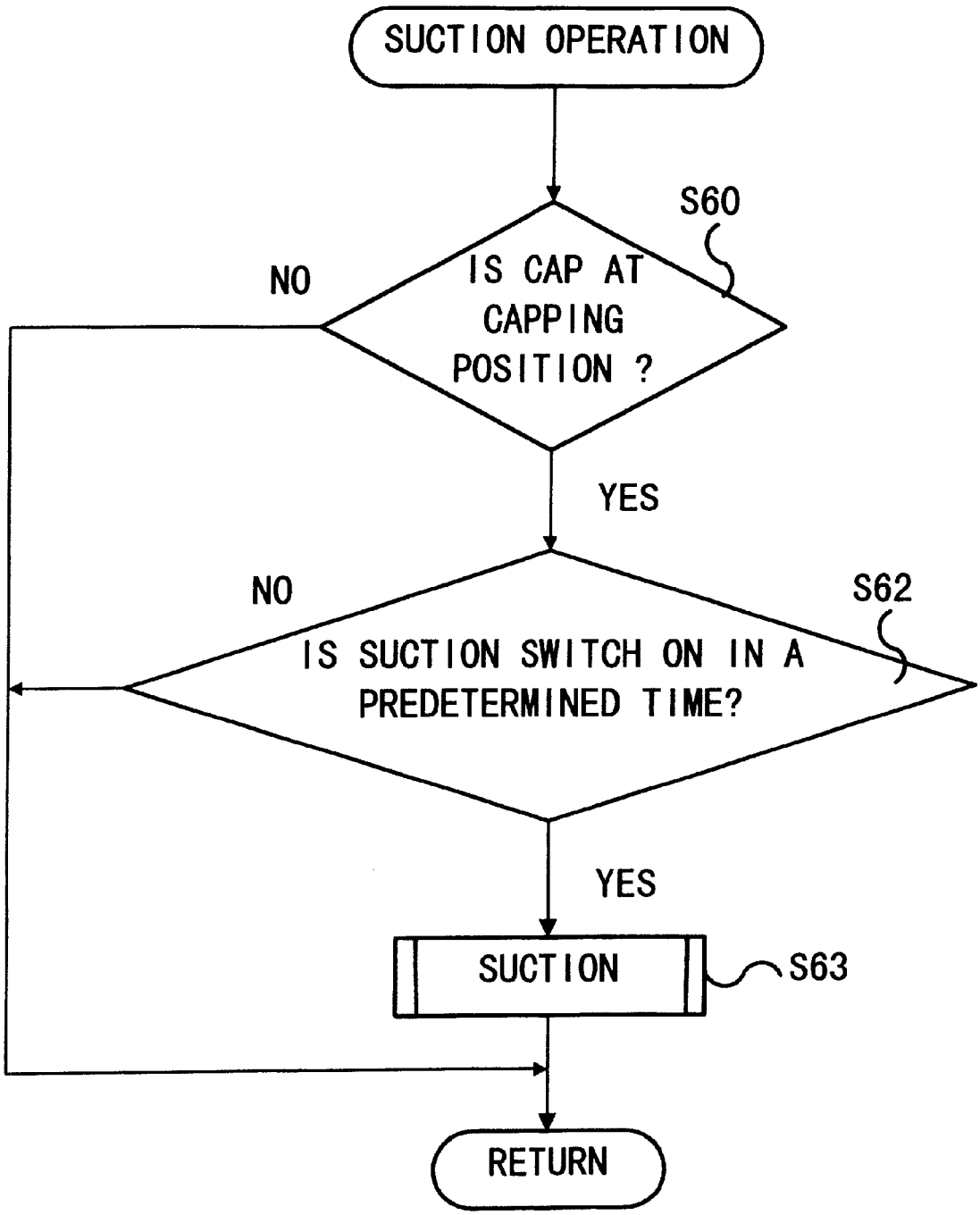
FIG. 9 is a flowchart of a subroutine for suction operation by a suction mechanism according to a second embodiment.

A modification of the suction operation subroutine is illustrated in FIG. 9. It is first determined in step S60 whether the cap member 31 is at the capping position relative to the recording head 2. If the cap member 31 is at the capping position (Yes in step S60), it is determined in step S62 whether the suction switch 14 has been turned on within a predetermined time, for example, 10 sec. If the suction switch 14 is turned on (Yes in step S62), the suction pump 42 is driven for a predetermined length of time (for example, 1 to 2 seconds) to perform suction of the ejection nozzles via the cap member 31 in step S63. That is, when a single switch (the suction switch 14 in this modification) is continually operated, i.e., double clicked, i.e., turned on a second time for this embodiment the inhibition of operation of the suction mechanism 40 is canceled so that the suction operation is performed. Therefore, an unnecessary suction operation caused by a single misoperation of the suction switch 14 is prevented. Thus the first operation of the suction switch 14 and the control device 50 constitute an inhibition device.

Figure 10:
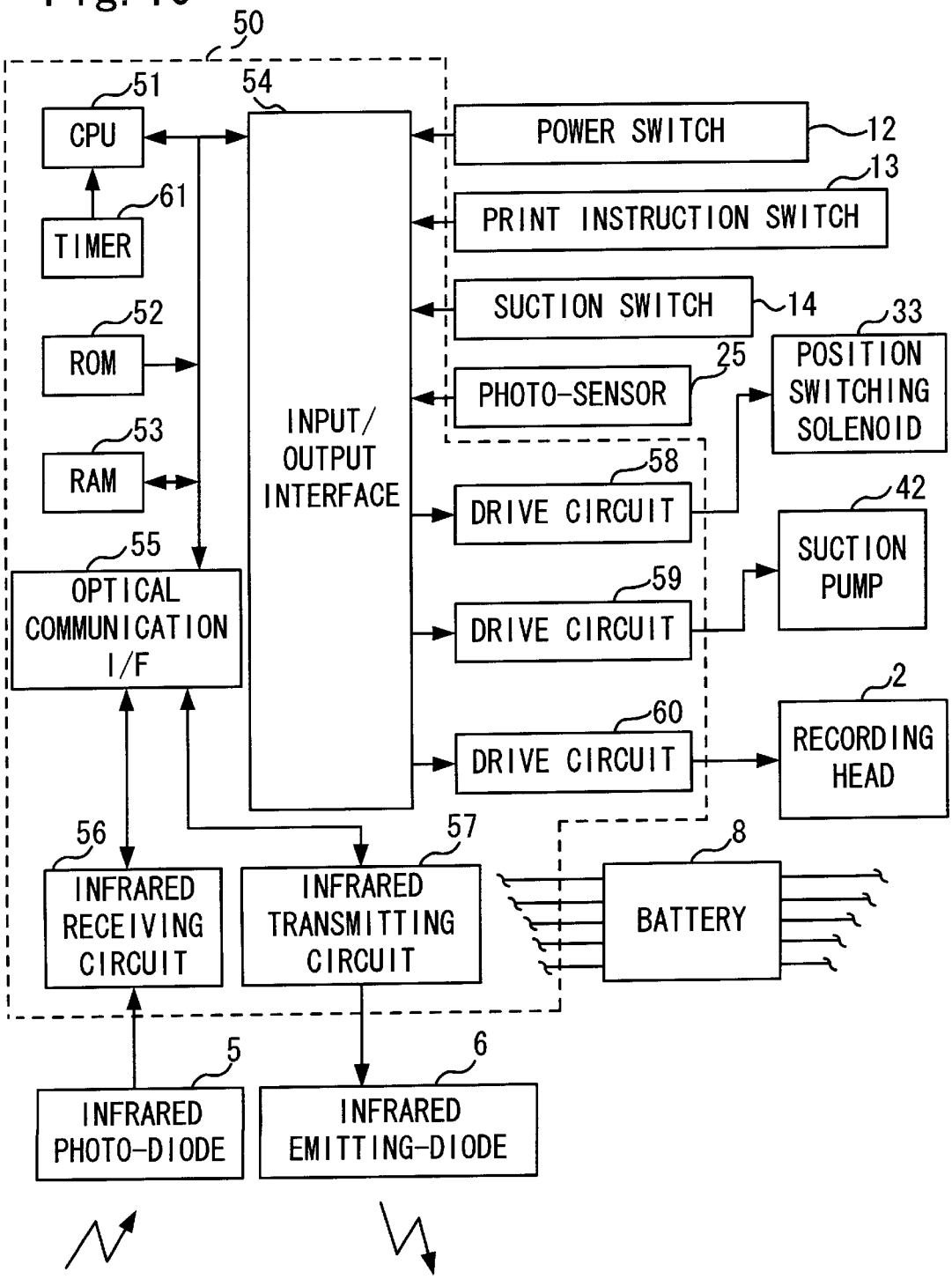
FIG. 10 is a block diagram of a control system of a recording apparatus according to a third embodiment.

A third embodiment will be described with reference to FIGS. 10 and 11. In the third embodiment, a timer 61 is connected to the CPU 51 of the control device 50 as shown in FIG. 10. The timer 61 measures the time elapsed from a previous operation of the head recovery device (suction mechanism 40). When the time measured by timer 61 reaches a predetermined length of time, the inhibition of operation of the head recovery device (suction mechanism 40) is canceled.

Figure 11:
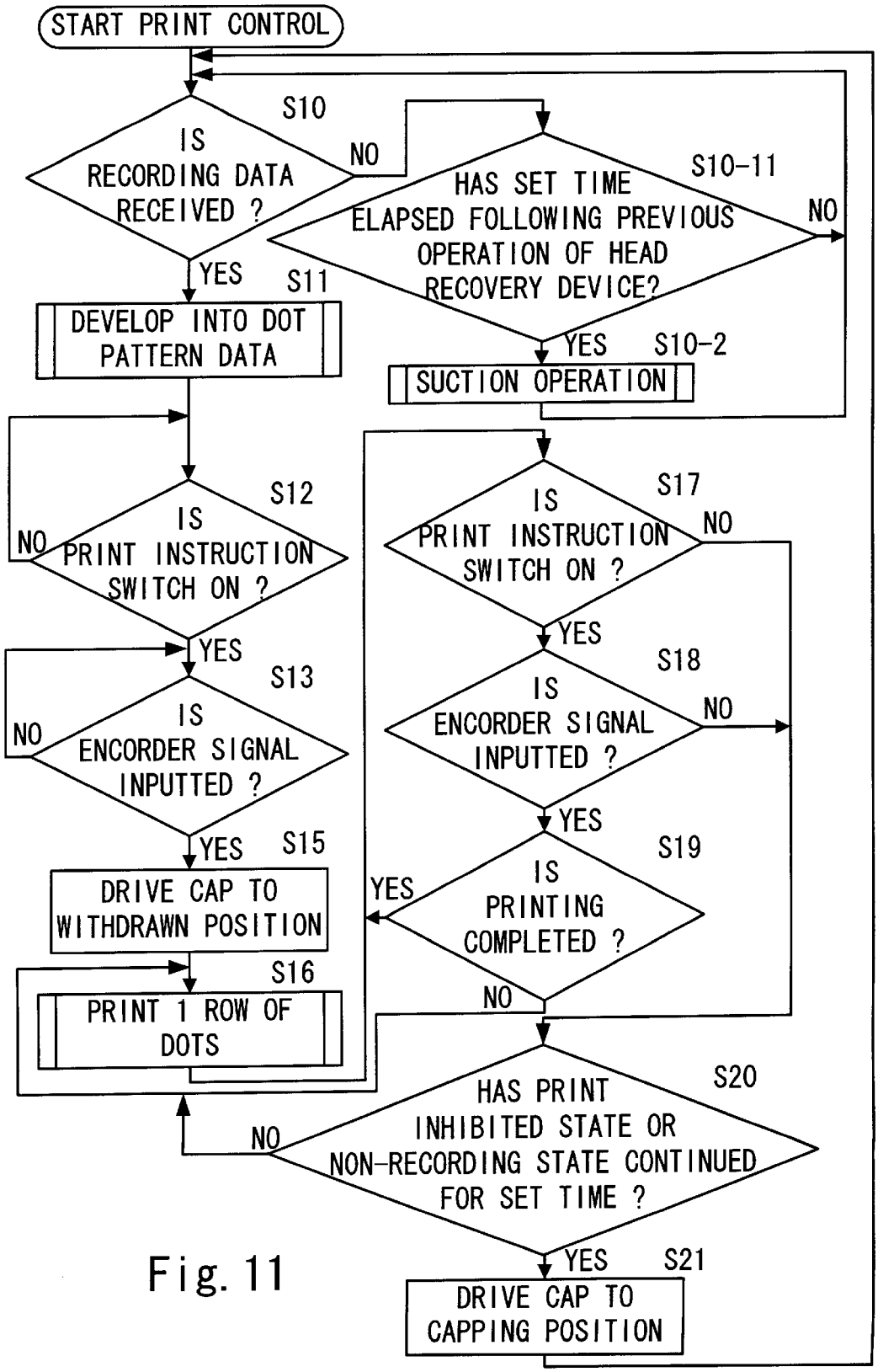
FIG. 11 is a flowchart of a printing control according to the third embodiment.

Referring to the flowchart of print control of FIG. 11, if recording data is not received (No in step S10), it is determined in step S10-11 whether a predetermined length of time has elapsed following a previous operation of the head recovery device (suction mechanism 40) on the basis of the time measured by the timer 61. The timer 61 is reset in response to an operation of the suction mechanism 40, and measures the time elapsed from the operation of the suction mechanism 40. When the predetermined length of time has elapsed following the previous operation of the suction mechanism 40 (Yes in step S10), the control device 50 starts suction operation by the suction mechanism 40 in step S10-2.

The suction operation subroutine is performed in the same manner as in the second embodiment, following the flowchart of FIG. 9. It is first determined in step S60 whether the cap member 31 is at the capping position relative to the recording head 2. If the cap member 31 is at the capping position (Yes in step S60), it is determined in step S62 whether the suction switch 14 is turned on. If the suction switch 14 is on (Yes in step S62), the suction pump 42 is driven for a predetermined length of time (for example, 1 to 2 seconds) to perform suction of the ejection nozzles via the cap member 31 in step S63. That is, only when the predetermined length of time has elapsed following the previous operation of the suction mechanism 40, the operation of the suction switch 14 becomes valid. The inhibition of operation of the suction mechanism 40 is thereby canceled so that the suction operation is performed. Therefore, the unnecessary performance of a great number of suction operations by the misoperation of the suction switch 14 in a short time is prevented and, therefore, unnecessary ink consumption is prevented. In this embodiment, the timer 61 and the control device 50 constitute the inhibition device.

A fourth embodiment will be described with reference to FIGS. 10 and 12. In the fourth embodiment, the timer 61 is connected to the CPU 51 of the control device 50. The timer 61 measures the time elapsed from the turning on of the power switch 12. When the time measured by timer 61 reaches a predetermined length of time, the inhibition of operation of the head recovery device (suction mechanism 40) is canceled.

Figure 12:
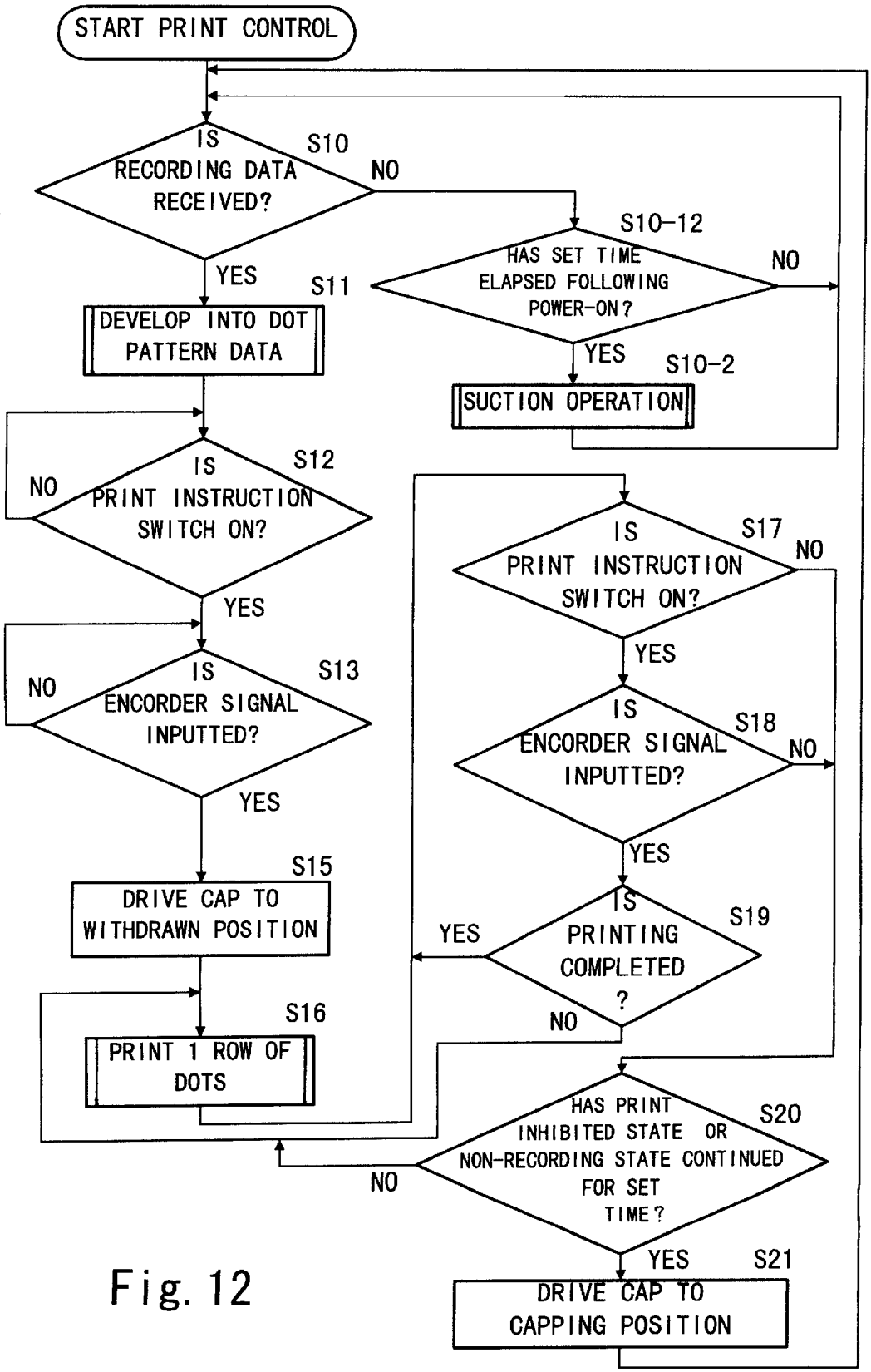
FIG. 12 is a flowchart of a printing control according to a fourth embodiment.

Referring to the flowchart of print control of FIG. 12, if recording data is not received (No in step S10), it is determined in step S10-12 whether a predetermined length of time has elapsed following the turning on of the power switch 12, on the basis of the time measured by the timer 61. The timer 61 measures the time elapsed from the turning on of the power switch 12. When the predetermined length of time has elapsed following the turning on of the power switch 12 (Yes in Step 10-12), the control device 50 starts suction operation by the suction mechanism 40 in step S10-2.

The suction operation subroutine is performed in the same manner as in the second embodiment, following the flowchart of FIG. 9. It is first determined in step S60 whether the cap member 31 is at the capping position relative to the recording head 2. If the cap member 31 is at the capping position (Yes in step S60), it is determined in step S62 whether the suction switch 14 is turned on. If the suction switch 14 is on (Yes in step S62), the suction pump 42 is driven for a predetermined length of time (for example, 1 to 2 seconds) to perform suction of the ejection nozzles via the cap member 31 in step S63. That is, only when the predetermined length of time has elapsed following the turning on of the power switch 12, the operation of the suction switch 14 becomes valid. The inhibition of operation of the suction mechanism 40 is thereby canceled so that the suction operation is performed. Therefore, unnecessary performance of a great number of suction operations by misoperation of the suction switch 14 in a short time is prevented and, therefore, unnecessary ink consumption is prevented. The power switch 12, the timer 61, and the control device 50 constitute the inhibition device.

Figure 13:
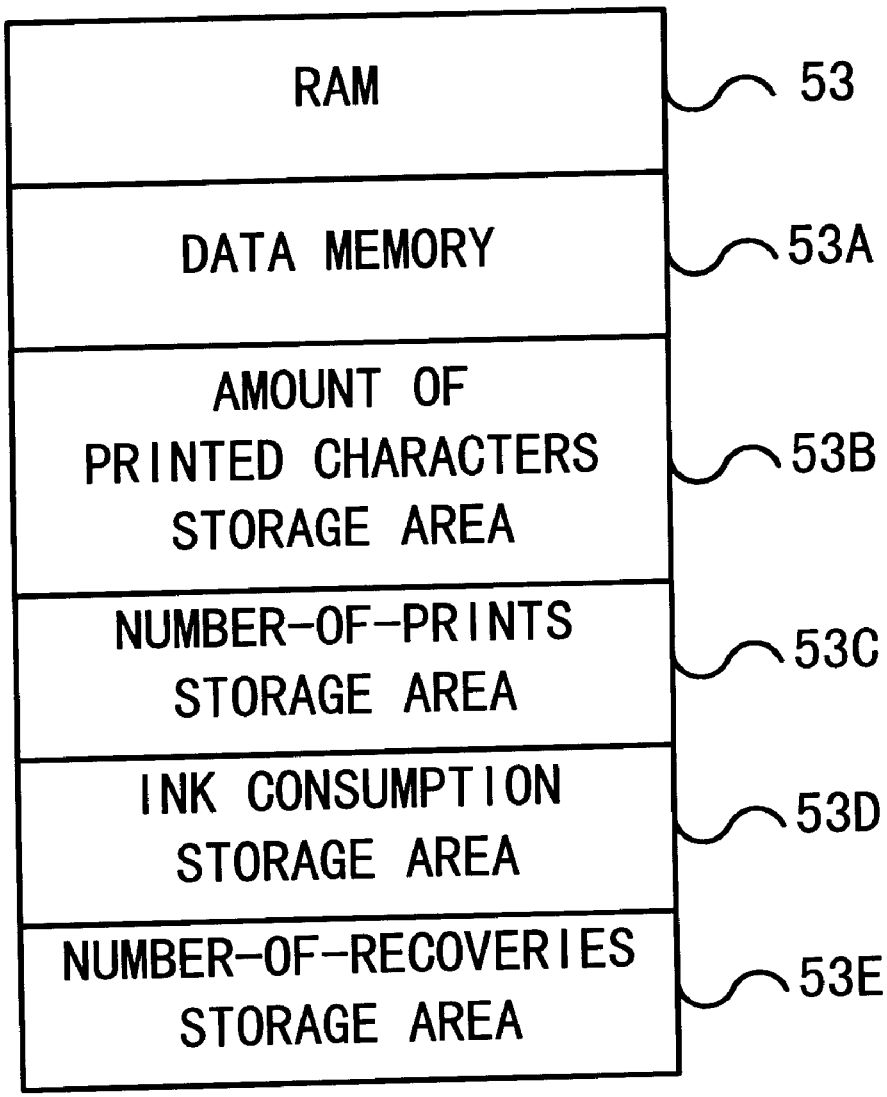
FIG. 13 schematically illustrates recording areas in a RAM.

A fifth embodiment will be described with reference to FIGS. 13 and 14. In the fifth embodiment, the RAM 53 has, in addition to a data memory 53A, an amount of printed characters storage area 53B, a number-of-prints storage area 53C for storing the number of print operations, and an ink consumption storage area 53D for storing the amount of ink used, as shown in FIG. 13. A count value of an amount of printed characters after a previous head recovery operation by the suction mechanism 40 is stored in the amount of printed characters storage area 53B.

Figure 14:
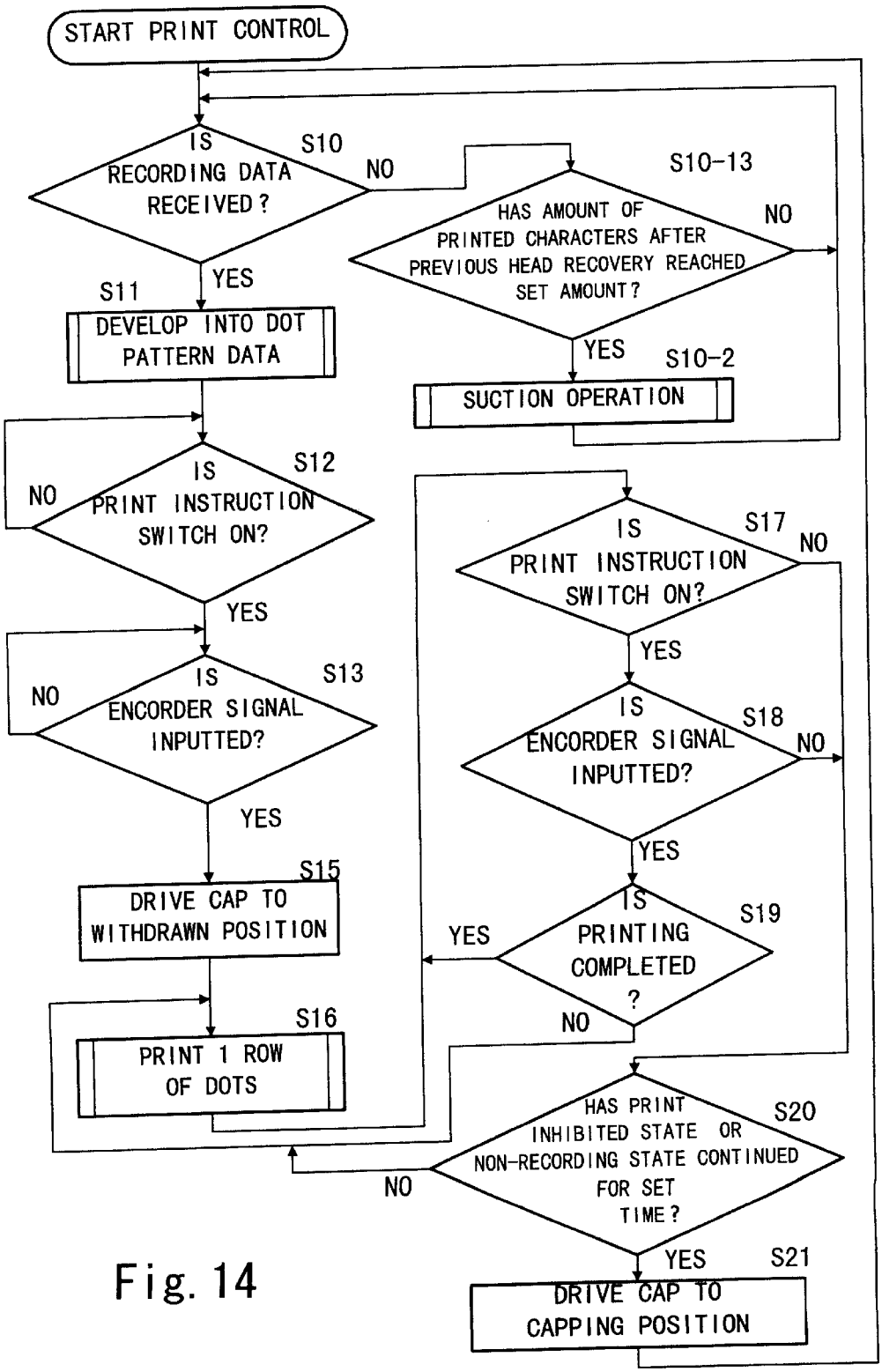
FIG. 14 is a flowchart of a printing control according to a fifth embodiment.

Referring to the flowchart of print control according to this embodiment illustrated in FIG. 14, the count value stored in the amount of printed characters storage area 53B is incremented every print of one character in the one dot row print operation of step S16. If recording data is not received (No in step S10), it is determined in step S10-13 whether the amount of print performed after a previous head recovery operation has reached or exceeded a predetermined amount of print, on the basis of the count value stored in the amount of printed characters storage area 53B. If the value stored in the amount of printed characters storage area 53B is equal to or greater than the predetermined amount of print (Yes in Step S10-13), the control device 50 starts a suction operation by the suction mechanism 40 in step S10-2.

The suction operation subroutine is performed in the same manner as in the second embodiment, following the flowchart of FIG. 9. It is first determined in step S60 whether the cap member 31 is at the capping position relative to the recording head 2. If the cap member 31 is at the capping position (Yes in step S60), it is determined in step S62 whether the suction switch 14 is turned on. If the suction switch 14 is on (Yes in step S62), the suction pump 42 is driven for a predetermined length of time (for example, 1 to 2 seconds) to perform suction of the ejection nozzles via the cap member 31 in step S63. That is, when the amount of print performed after a previous head recovery operation has reached or exceeded the predetermined amount of print, the operation of the suction switch 14 becomes valid. The inhibition of operation of the suction mechanism 40 is thereby canceled so that the suction operation is performed. Therefore, unnecessary performance of a great number of suction operations by misoperation of the suction switch 14 before the amount of print performed after a previous head recovery operation has reached or exceeded the predetermined amount is prevented and, therefore, unnecessary ink consumption is prevented. Thus, the inhibition device is the control device 50, a counter therein, and its RAM 53.

Figure 15:
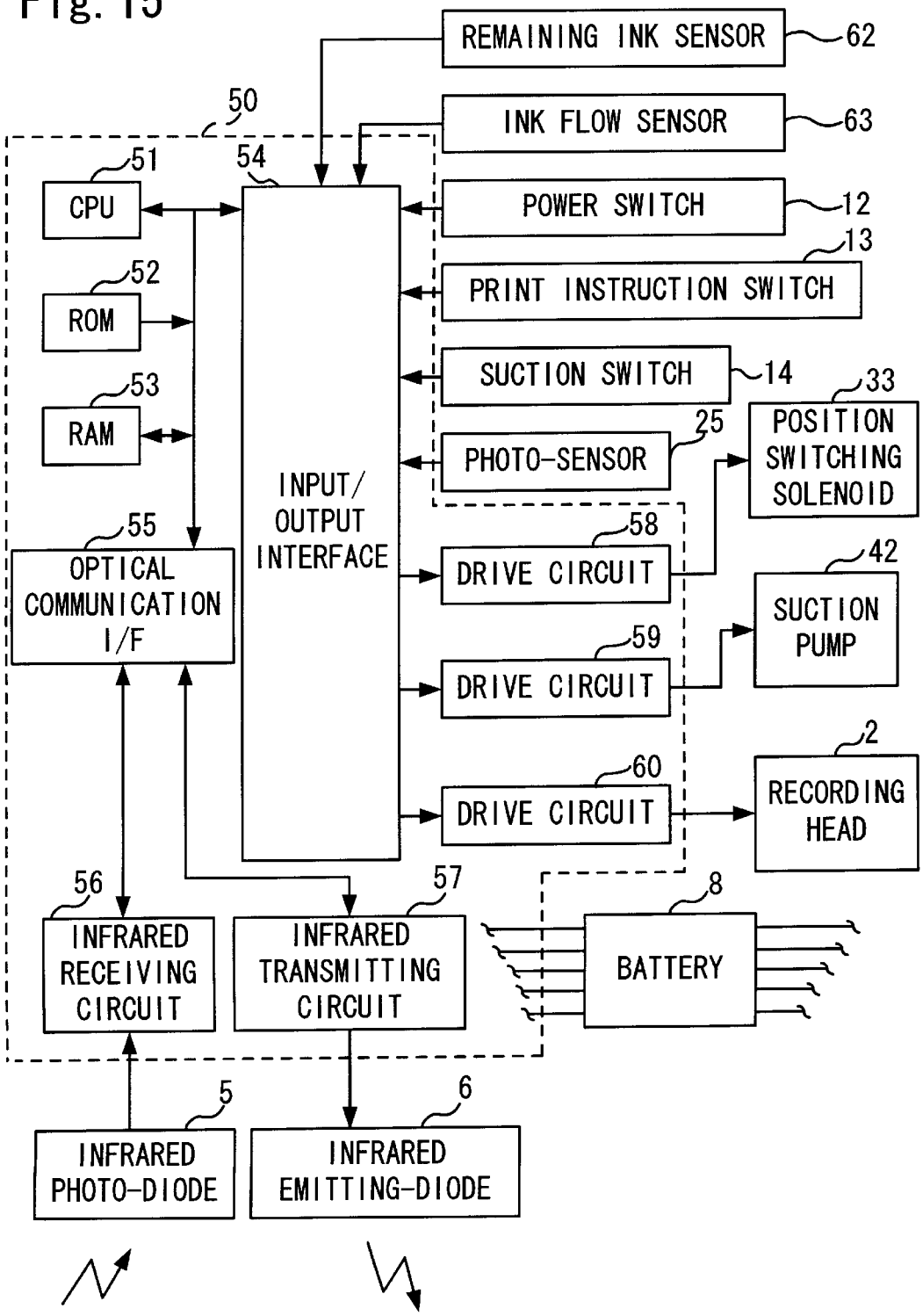
FIG. 15 is a block diagram of a control system of a recording apparatus according to a sixth embodiment.

A sixth embodiment will be described with reference to FIGS. 13, 15 and 16. In the sixth embodiment, the input-output interface 54 is further connected to an ink flow sensor 63 for detecting the flow of ink from the ink tank 15 to the recording head 2, as shown in FIG. 15. The accumulated count value of ink consumed which is output by the ink flow sensor 63 after a previous head recovery operation of the head recovery device (suction mechanism 40) is stored in the ink consumption storage area 53D of the RAM 53 shown in FIG. 13.

Figure 16:
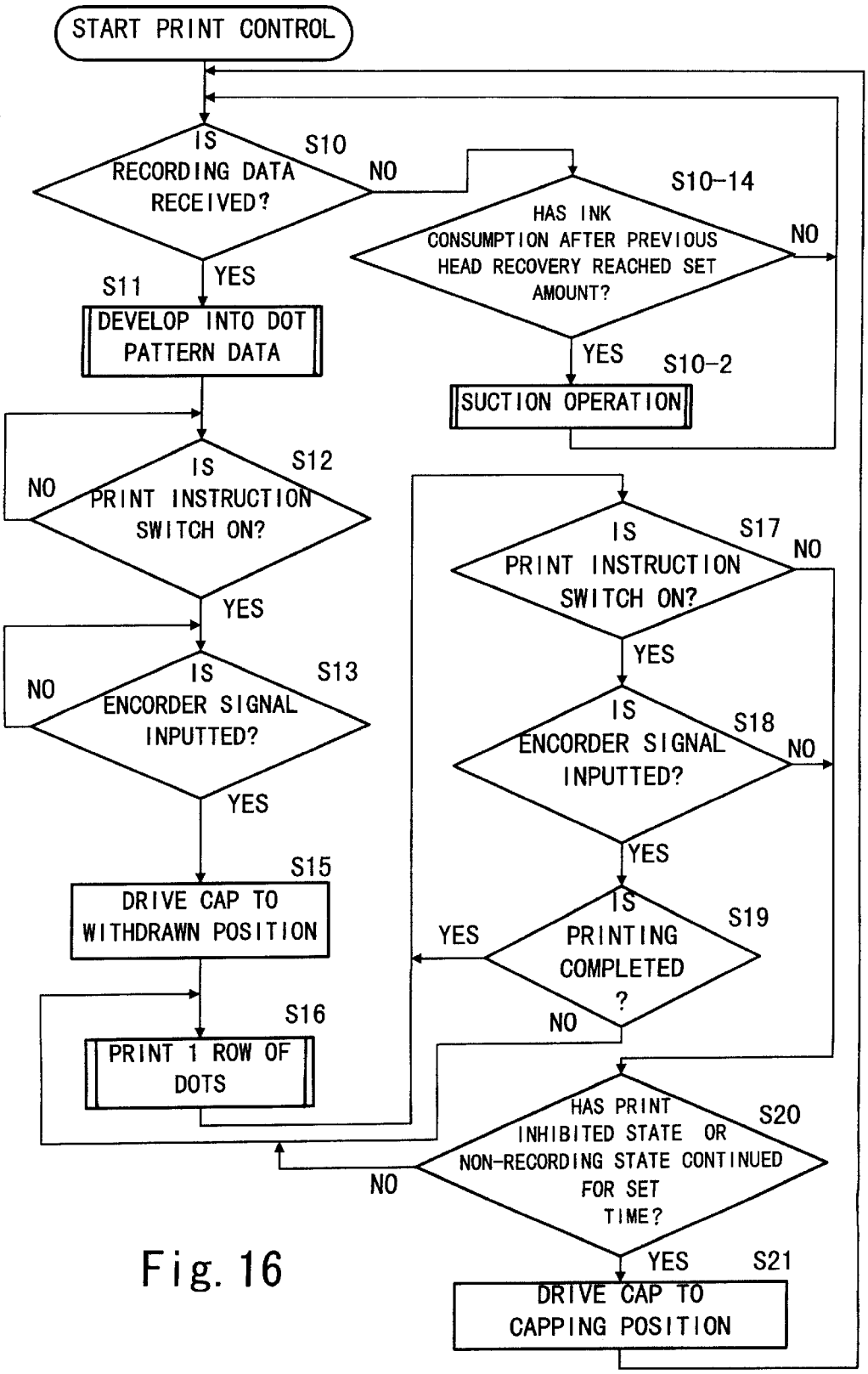
FIG. 16 is a flowchart of a printing control according to the sixth embodiment.

Referring to the flowchart of print control according to this embodiment illustrated in FIG. 16, if recording data is not received (No in step S10), it is determined in step S10-14 whether the amount of ink consumed after a previous operation of the head recovery device (suction mechanism 40) has reached or exceeded a predetermined amount, on the basis of the accumulated value stored in the consumption storage area 53D. If the value stored in the consumption storage area 53D is equal to or greater than the predetermined amount of ink consumption (Yes in Step S10-14), the control device 50 starts the suction operation by the suction mechanism 40 in step S10-2.

The suction operation subroutine is performed in the same manner as in the second embodiment, following the flowchart of FIG. 9. It is first determined in step S60 whether the cap member 31 is at the capping position relative to the recording head 2. If the cap member 31 is at the capping position (Yes in step S60), it is determined in step S62 whether the suction switch 14 is turned on. If the suction switch 14 is on (Yes in step S62), the suction pump 42 is driven for a predetermined length of time (for example, 1 to 2 seconds) to perform suction of the ejection nozzles via the cap member 31 in step S63. That is, when the amount of ink consumed after a previous head recovery operation has reached or exceeded the predetermined amount, the operation of the suction switch 14 becomes valid. The inhibition of the operation of the suction mechanism 40 is thereby canceled so that the suction operation is performed. Therefore, the unnecessary performance of a great number of suction operations by misoperation of the suction switch 14 before the amount of ink consumed after a previous head recovery operation has reached or exceeded the predetermined amount is prevented and, therefore, unnecessary ink consumption is prevented. Thus, the ink flow sensor and the control device 50, with its RAM 53, constitute the inhibition device.

A seventh embodiment will be described with reference to FIGS. 13 and 17. In the seventh embodiment, the number of print operations following a previous operation of the head recovery device (suction mechanism 40) is stored in the number-of-prints storage area 53C of the RAM 53. The number of print operations herein means the number of times that printing is instructed.

Figure 17:
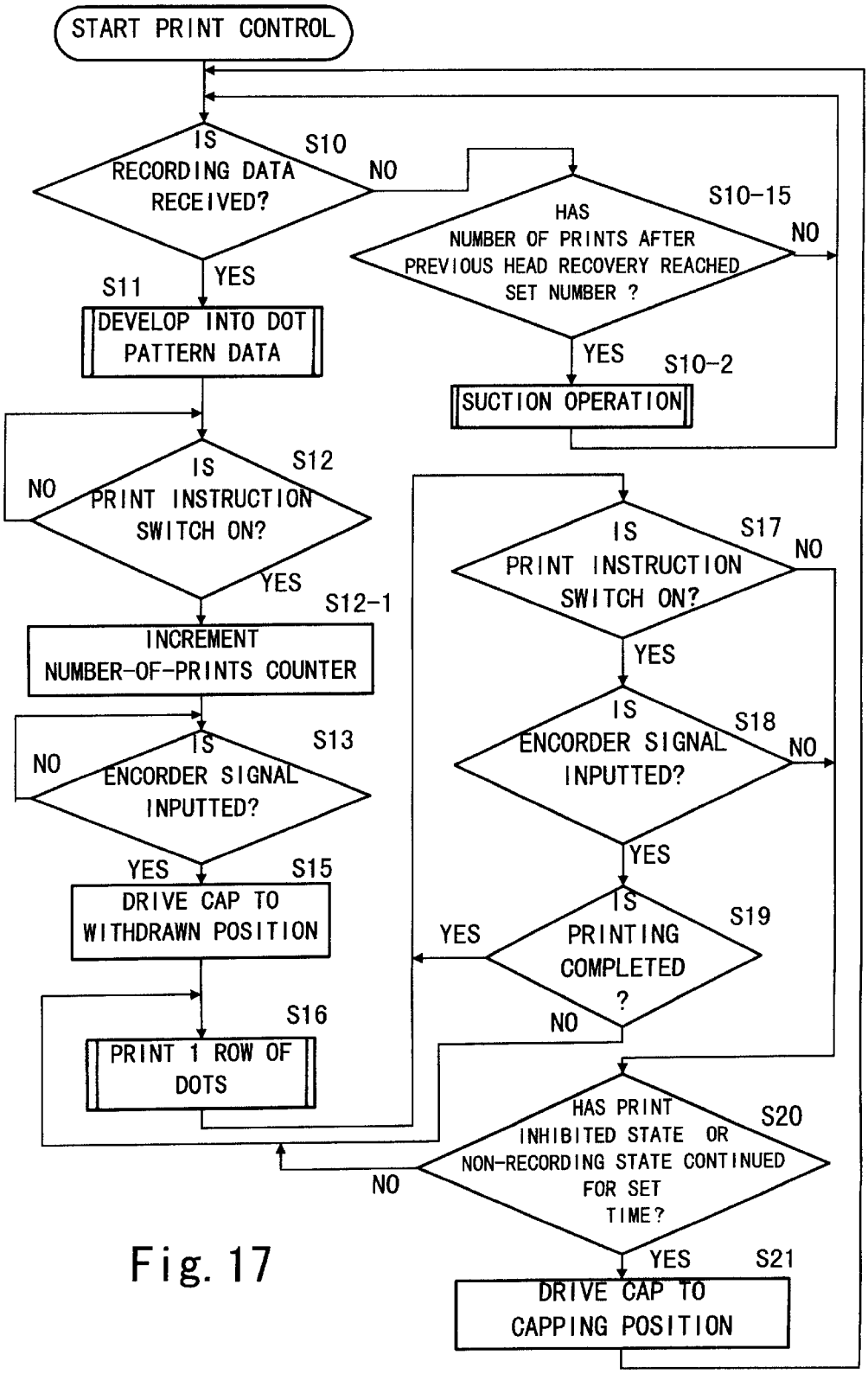
FIG. 17 is a flowchart of a printing control according to a seventh embodiment.

Referring to the flowchart of print control according to this embodiment shown in FIG. 17, every time the print instruction switch 13 is turned on, a number-of-prints counter is incremented in step S12-1. The incremented count of the number-of-prints counter is stored in the number-of-prints storage area 53C of the RAM 53.

If recording data is not received (No in step S10), it is determined in step S10-15 whether the number of print operations following a previous operation of the head recovery device (suction mechanism 40) has reached or exceeded a predetermined number, on the basis of the count value stored in the number-of-prints storage area 53C. If the value stored in the number-of-prints storage area 53C is equal to or greater than the predetermined number (Yes in Step S10-15), the control device 50 starts the suction operation by the suction mechanism 40 in step S10-2.

The suction operation subroutine is performed in the same manner as in the second embodiment, following the flowchart of FIG. 9. It is first determined in step S60 whether the cap member 31 is at the capping position relative to the recording head 2. If the cap member 31 is at the capping position (Yes in step S60), it is determined in step S62 whether the suction switch 14 is turned on. If the suction switch 14 is on (Yes in step S62), the suction pump 42 is driven for a predetermined length of time (for example, 1 to 2 seconds) to perform suction of the ejection nozzles via the cap member 31 in step S63. That is, when the number of print operations following a previous head recovery operation has reached or exceeded the predetermined number, the operation of the suction switch 14 becomes valid. The inhibition of the operation of the suction mechanism 40 is thereby canceled so that the suction operation is performed. Therefore, the unnecessary performance of a great number of suction operations by the misoperation of the suction switch 14 before the number of print operations following a previous head recovery operation has reached or exceeded the predetermined number is prevented and, therefore, unnecessary ink consumption is prevented. Thus, the print switch 13, the control device 50, and its RAM 53, constitute the inhibition device for the embodiment.

An eighth embodiment will be described with reference to FIGS. 13 and 18. The eighth embodiment is a modification of the fifth embodiment. In the eighth embodiment, the count value of amount of printed characters after the power switch 12 has been turned on is stored in the amount of printed characters storage area 53B.

Figure 18:
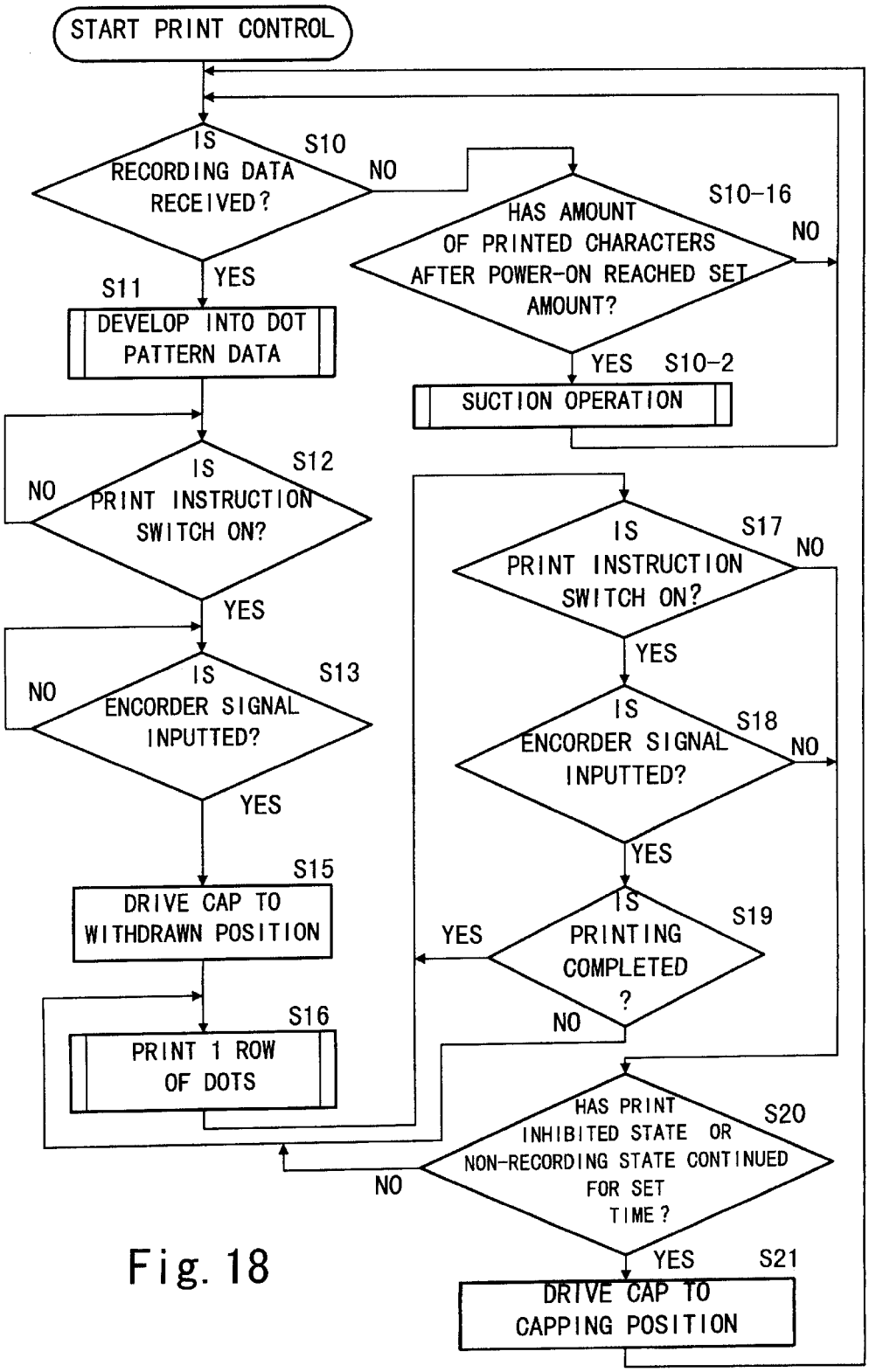
FIG. 18 is a flowchart of a printing control according to an eighth embodiment.

Referring to the flowchart of print control according to this embodiment illustrated in FIG. 18, the count value stored in the amount of printed characters storage area 53B corresponding to the amount of printed characters after the power switch 12 has been turned on is incremented every print of one character in the one dot row print operation of step S16. If recording data is not received (No in step S10), it is determined in step S10-16 whether the amount of print performed after the turning on of the power switch 12 has reached or exceeded a predetermined amount of print, on the basis of the count value stored in the amount of printed characters storage area 53B. If the value stored in the amount of printed characters storage area 53B is equal to or greater than the predetermined amount of print (Yes in Step S10-16), the control device 50 starts the suction operation by the suction mechanism 40 in step S10-2.

The suction operation subroutine is performed in the same manner as in the second embodiment, following the flowchart of FIG. 9. It is first determined in step S60 whether the cap member 31 is at the capping position relative to the recording head 2. If the cap member 31 is at the capping position (Yes in step S60), it is determined in step S62 whether the suction switch 14 is turned on. If the suction switch 14 is on (Yes in step S62), the suction pump 42 is driven for a predetermined length of time (for example, 1 to 2 seconds) to perform suction of the ejection nozzles via the cap member 31 in step S63. That is, when the amount of print performed after the turning on of the power switch 12 has reached or exceeded the predetermined amount of print, the operation of the suction switch 14 becomes valid. The inhibition of the operation of the suction mechanism 40 is thereby canceled so that the suction operation is performed. Therefore, the unnecessary performance of a great number of suction operations by misoperation of the suction switch 14 before the amount of print performed after the turning on of the power switch 12 has reached or exceeded the predetermined amount is prevented and, therefore, unnecessary ink consumption is prevented. Thus, the control device 50 and its RAM 53 constitute the inhibition device of the embodiment.

A ninth embodiment will be described with reference to FIGS. 13, 15 and 19. In the ninth embodiment, the input-output interface 54 is further connected to the remaining ink amount sensor 62 for detecting the amount of ink remaining in the ink tank 15, and the ink flow sensor 63 for detecting the flow of ink from the ink tank 15 to the recording head 2, as shown in FIG. 15. The accumulated count value of ink consumed which is output by the ink flow sensor 63 after the power switch 12 has been turned on is stored in the consumption storage area 53D of the RAM 53 shown in FIG. 13.

Figure 19:
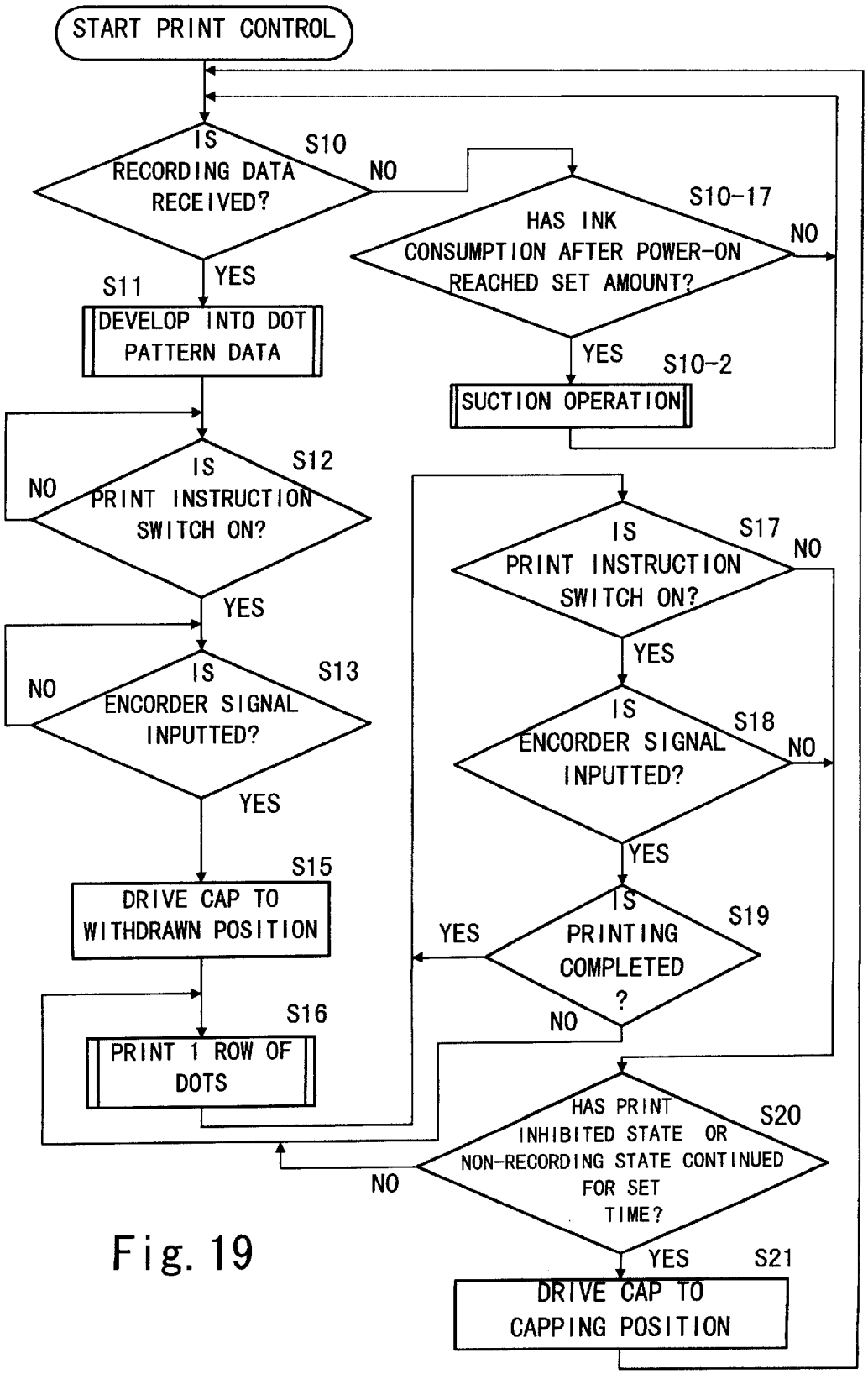
FIG. 19 is a flowchart of a printing control according to a ninth embodiment.

Referring to the flowchart of print control according to this embodiment illustrated in FIG. 19, if recording data is not received (No in step S10), it is determined in step S10-17 whether the amount of ink consumed after the turning on of the power switch 12 has reached or exceeded a predetermined amount, on the basis of the accumulated value stored in the consumption storage area 53D. If the value stored in the consumption storage area 53D is equal to or greater than the predetermined amount of ink consumption (Yes in Step S10-17), the control device 50 starts the suction operation by the suction mechanism 40 in step S10-2.

The suction operation subroutine is performed in the same manner as in the second embodiment, following the flowchart of FIG. 9. It is first determined in step S60 whether the cap member 31 is at the capping position relative to the recording head 2. If the cap member 31 is at the capping position (Yes in step S60), it is determined in step S62 whether the suction switch 14 is turned on. If the suction switch 14 is on (Yes in step S62), the suction pump 42 is driven for a predetermined length of time (for example, 1 to 2 seconds) to perform suction of the ejection nozzles via the cap member 31 in step S63. That is, when the amount of ink consumed after the turning on of the power switch 12 has reached or exceeded the predetermined amount, the operation of the suction switch 14 becomes valid. The inhibition of the operation of the suction mechanism 40 is thereby canceled so that the suction operation is performed. Therefore, the unnecessary performance of a great number of suction operations by misoperation of the suction switch 14 before the amount of ink consumed after the turning on of the power switch 12 has reached or exceeded the predetermined amount is prevented and, therefore, unnecessary ink consumption is prevented. The inhibition device is constituted of the remaining ink amount sensor 62, the ink flow sensor 63, and the control device 50 with its RAM 53.

A tenth embodiment will be described with reference to FIGS. 13 and 20. In the tenth embodiment, the number of print operations performed after the power switch 12 has been turned on is stored in the number-of-prints storage area 53C of the RAM 53. The number of print operations herein means the number of times that printing is instructed.

Figure 20:
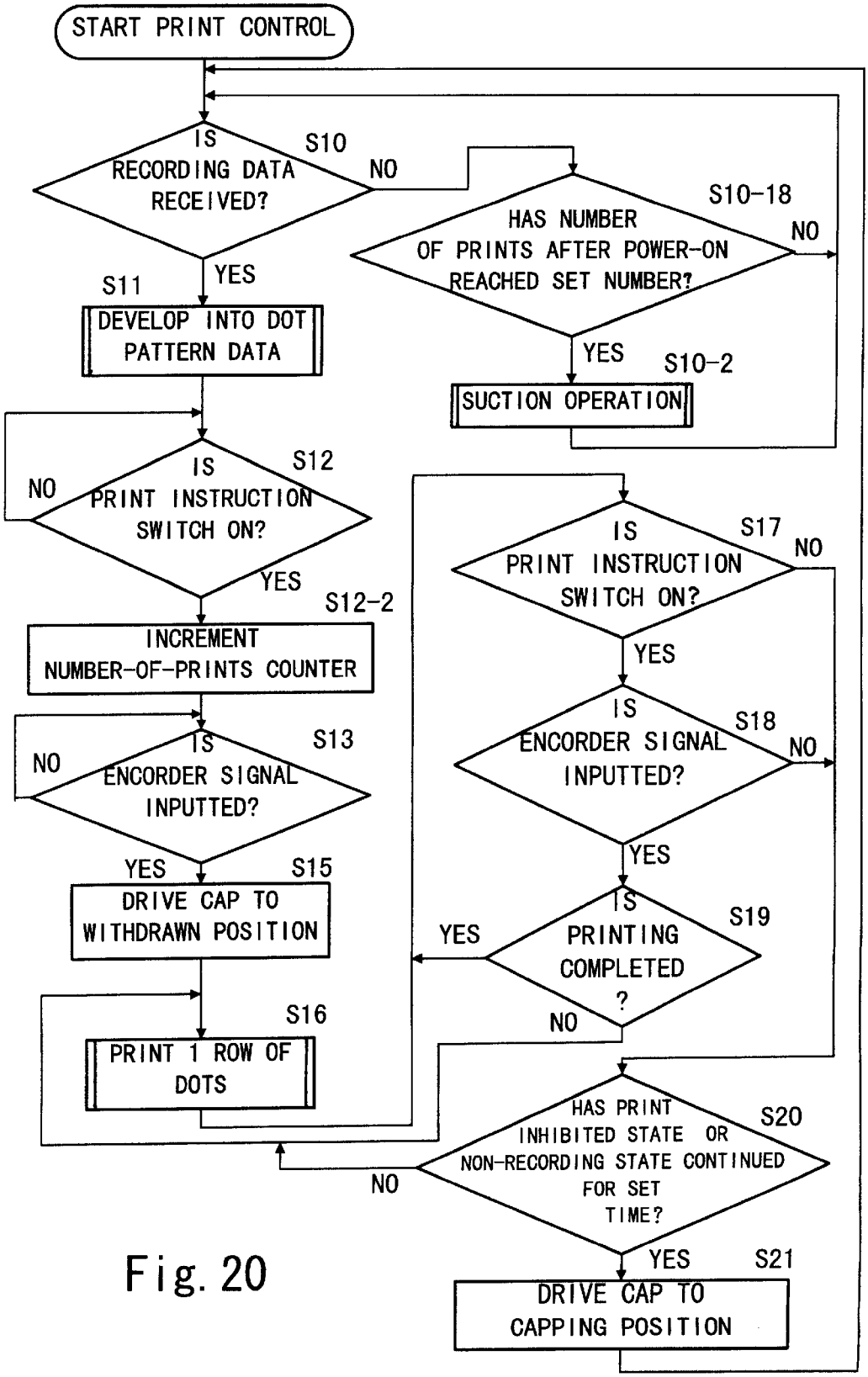
FIG. 20 is a flowchart of a printing control according to a tenth embodiment.

Referring to the flowchart of print control according to this embodiment shown in FIG. 20, every time the print instruction switch 13 is turned on, a number-of-prints counter is incremented in step S12-2. The incremented count of the number-of-prints counter is stored in the number-of-prints storage area 53C of the RAM 53. This stored value is reset every time the power switch 12 is turned on, and the value is incremented every time the print instruction switch 13 is turned on.

If recording data is not received (No in step S10), it is determined in step S10-18 whether the number of print operations following the turning on of the power switch 12 has reached or exceeded a predetermined number, on the basis of the count value stored in the number-of-prints storage area 53C. If the value stored in the number-of-prints storage area 53C is equal to or greater than the predetermined number (Yes in Step 10-18), the control device 50 starts suction operation by the suction mechanism 40 in step S10-2.

The suction operation subroutine is performed in the same manner as in the second embodiment, following the flowchart of FIG. 9. It is first determined in step S60 whether the cap member 31 is at the capping position relative to the recording head 2. If the cap member 31 is at the capping position (Yes in step S60), it is determined in step S62 whether the suction switch 14 is turned on. If the suction switch 14 is on (Yes in step S62), the suction pump 42 is driven for a predetermined length of time (for example, 1 to 2 seconds) to perform suction of the ejection nozzles via the cap member 31 in step S63. That is, when the number of print operations following the turning on of the power switch 12 has reached or exceeded the predetermined number, the operation of the suction switch 14 becomes valid. The inhibition of the operation of the suction mechanism 40 is thereby canceled so that the suction operation is performed. Therefore, the unnecessary performance of a great number of suction operations by misoperation of the suction switch 14 before the number of print operations following the turning on of the power switch 12 has reached or exceeded the predetermined number is prevented and, therefore, unnecessary ink consumption is prevented. The control device 50, and its RAM 53A, constitute the inhibition device.

Figure 21:
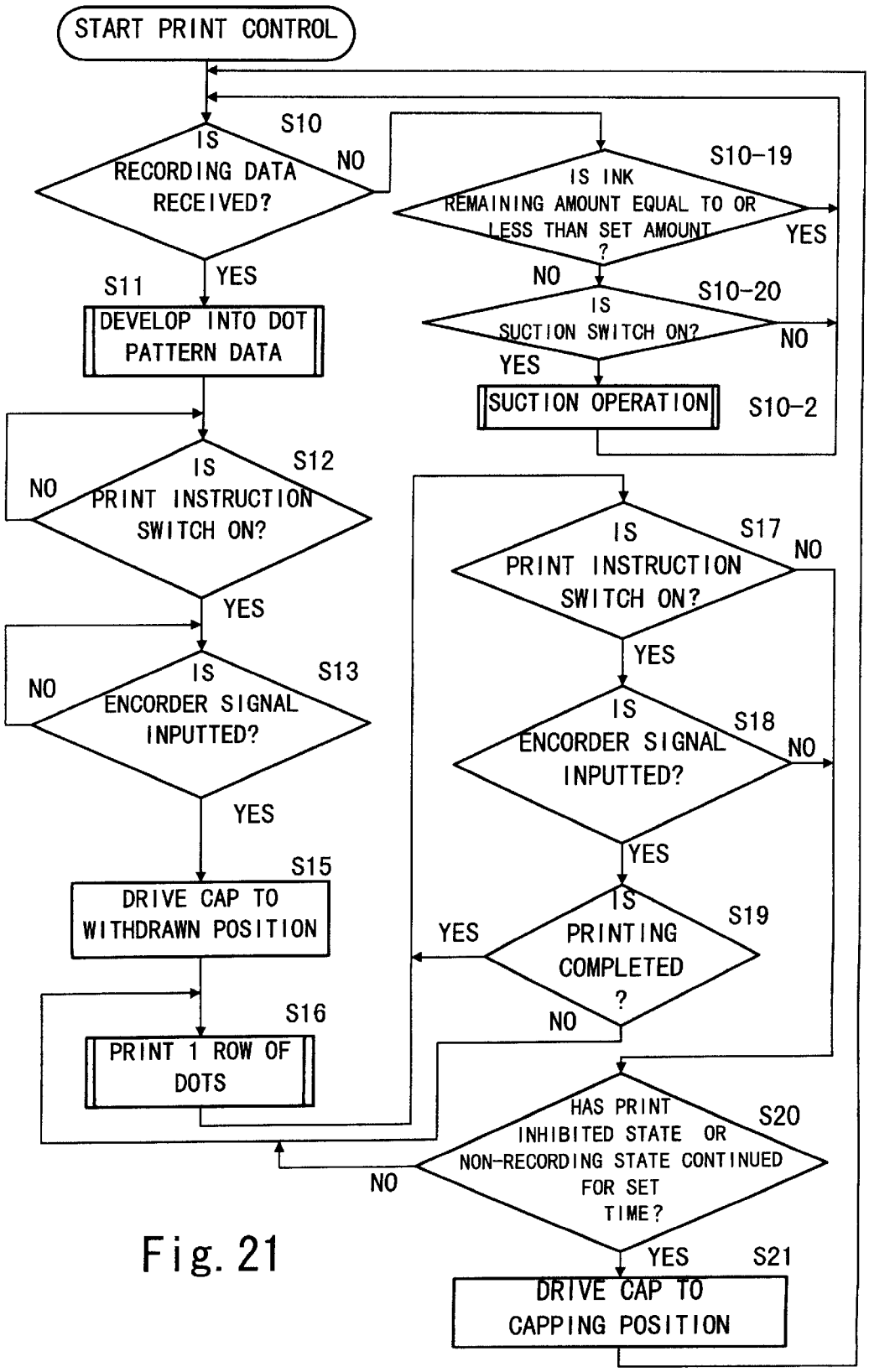
FIG. 21 is a flowchart of a printing control according to an eleventh embodiment.

An eleventh embodiment will be described with reference to FIGS. 15 and 21. In the eleventh embodiment, the input-output interface 54 of the control device 50 is further connected to the remaining ink amount sensor 62 for detecting the amount of ink remaining in the ink tank 15. Referring to the flowchart of print control according to this embodiment illustrated in FIG. 21, if recording data is not received (No in step S10), it is determined in step S10-19 whether the amount of ink remaining detected by the remaining ink amount sensor 62 is equal to or less than a predetermined amount. If the remaining ink amount is equal to or less than the predetermined amount (Yes in step S10-19), the operation returns to step S10, thereby avoiding cancellation of the inhibition of operation of the head recovery device (suction mechanism 40). With this structure, when the amount of remaining ink has become small, cancellation of the inhibition of recovery operation is prevented, thereby avoiding an inconvenient incident wherein a small amount of ink left is completely consumed by recovery operation so that printing becomes impossible. Thus, the remaining ink amount sensor 62 and the control device 50 constitute the inhibition device.

Figure 22:
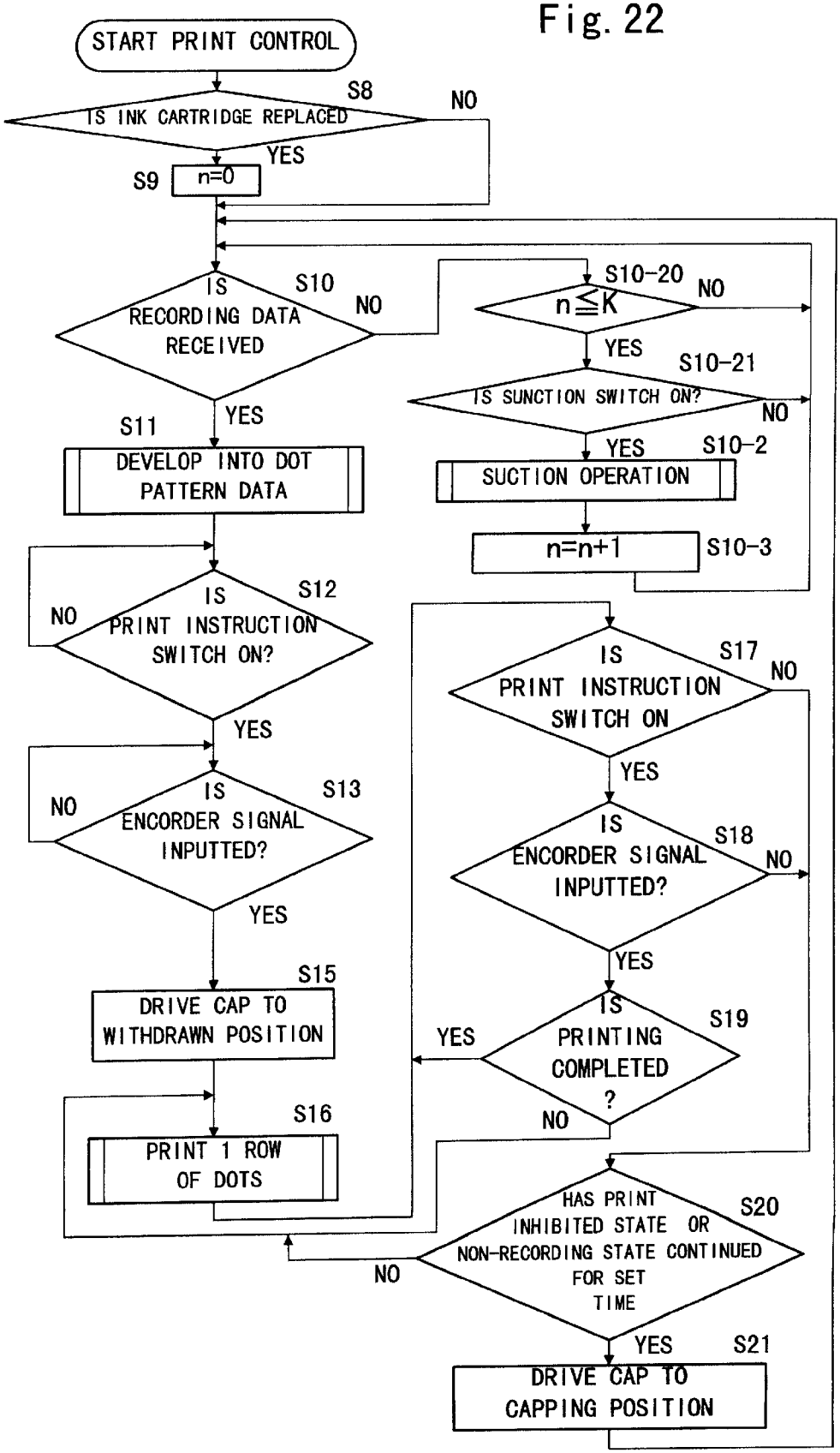
FIG. 22 is a flowchart of a printing control according to a twelfth embodiment.

A twelfth embodiment will be described with reference to the flowchart of FIG. 22. The twelfth embodiment employs a second counter for counting the number of operations of the head recovery device (suction mechanism 40). When the count of the second counter reaches a predetermined number, cancellation of the inhibition of operation of the head recovery device is prevented.

As illustrated in the flowchart of print control of the twelfth embodiment, when an ink cartridge is replaced, the count of the second counter is cleared to n=0. If recording data is not received (No in step S10), it is determined in step S10-20 whether the value n of the second counter is equal to or less than a predetermined number k. If the counter value n is equal to or less than the predetermined number k (Yes in step S10-21), it is determined in step S10-21 whether the suction switch 14 is turned on. If the suction switch 14 is on (Yes in step S10-22), the control device 50 performs suction operation in step S10-2, and increments the value n of the second counter in step S10-3, and returns to step S10. When the value n of the second counter becomes has become greater than the predetermined number k (No in step S10-21), the operation returns to step S10, thereby avoiding cancellation of the inhibition of operation of the head recovery device. The value n of the second counter is stored in a number-of-recoveries storage area 53E of the RAM 53 shown in FIG. 13.

In the twelfth embodiment, the number of operations of the head recovery device (suction mechanism 40) is counted, and recovery operation is prevented if the count exceeds the predetermined number. Therefore, unnecessary performance of a great number of recovery operations by misoperation of the suction switch 14 is prevented and, therefore, unnecessary ink consumption is prevented. Thus, the control device 50 and its RAM 53 constitute the inhibition device. In all embodiments, the control device 50 can be considered the inhibition override mechanism as it checks for a condition precedent before allowing an activated manual switch commanding recovery to be executed.

Figure 23:
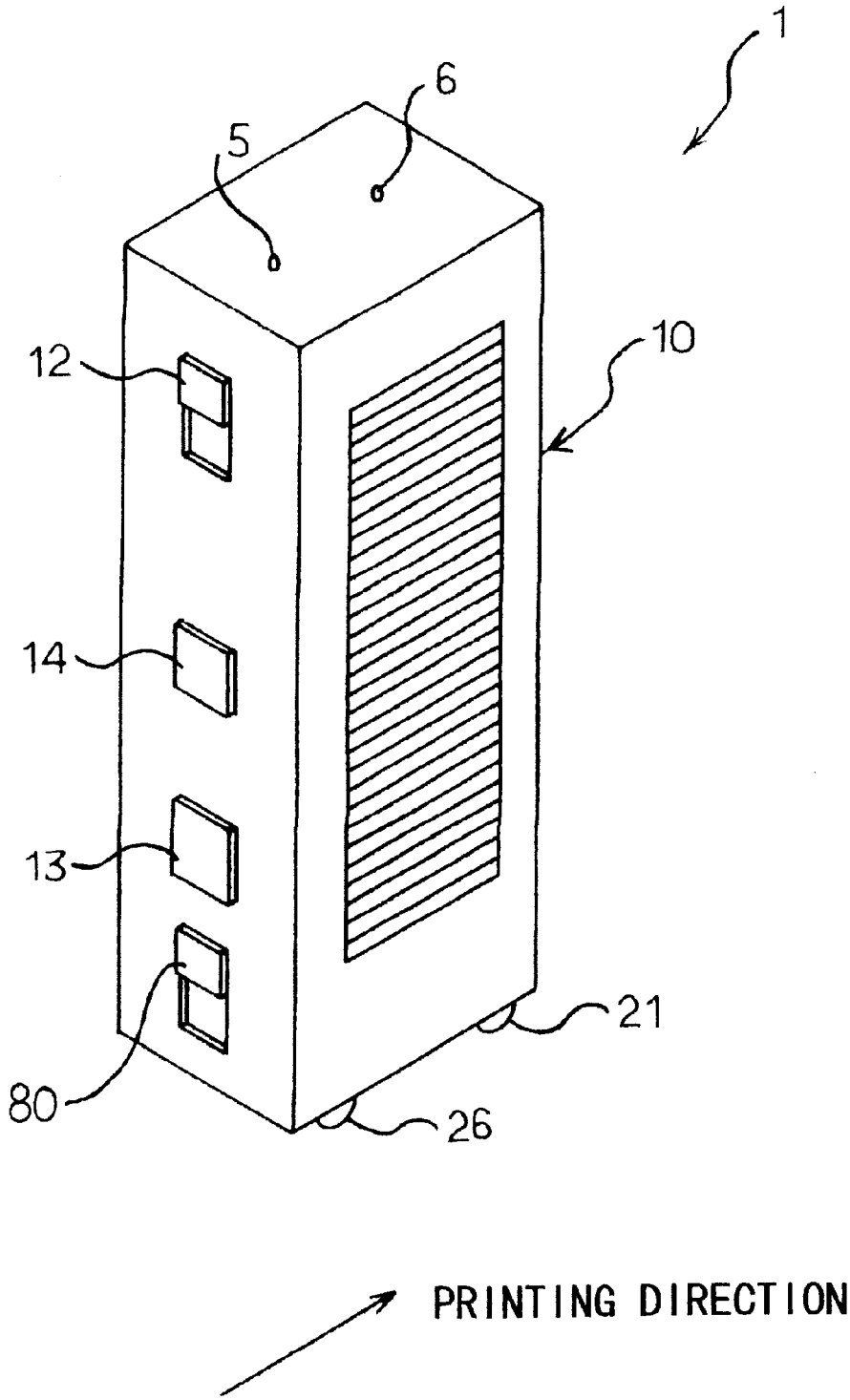
FIG. 23 is an exterior view of a manually-driven printing apparatus according to a further embodiment of the invention.

A slide switch 80 may be provided for selecting whether to set a condition for inhibition by an inhibiting device, as in a modification shown in FIG. 23, thereby enabling selection of whether to set a condition for inhibition by the inhibiting device. Furthermore, it is also possible to provide a device for setting a plurality of conditions for inhibition or to allow the head recovery device to be driven without any inhibition conditions for the inhibiting device.

Figure 24:
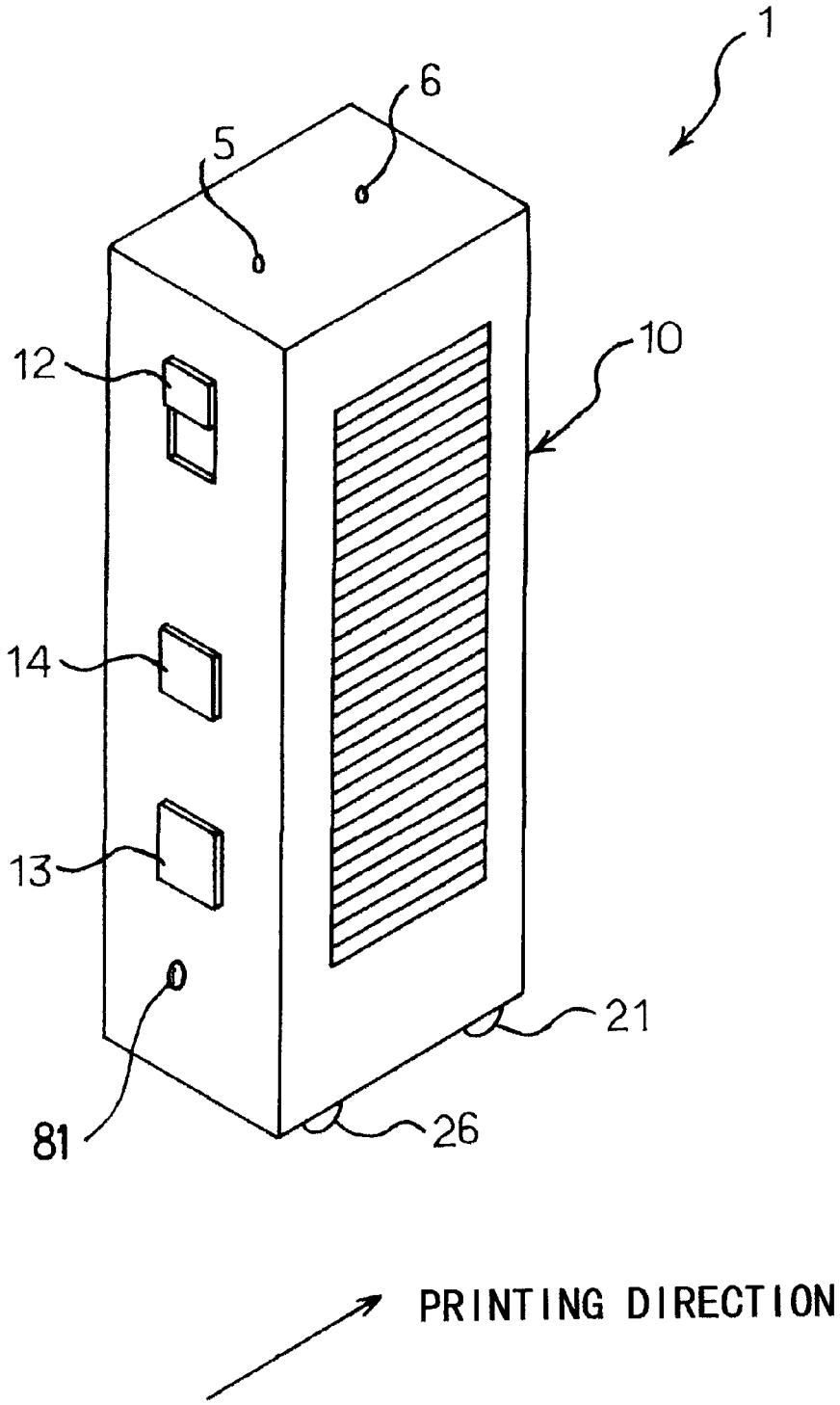
FIG. 24 is an exterior view of a manually-driven printing apparatus according to a still further embodiment of the invention.

Furthermore, it is possible to provide a reset switch 81 as shown in FIG. 24. If the head recovery operation is really needed under a condition for inhibition by the inhibiting device, a recovery operation is allowed by pressing the reset switch 81. The reset switch may be designed so that the reset switch is not easily pressed by a finger during normal operation. For example, the reset switch may be disposed inside a small recess so that the reset switch is pressed only by a pen tip or the like. Such a reset device is not limited to the reset switch, but may be a device that cancels the inhibition condition upon receiving a permitting instruction from an external device.

The above-described embodiments are for small-size portable recording apparatuses, such as manually-driven printing apparatus, and particularly useful for apparatuses equipped with small-capacity ink tanks.

It is to be understood that the invention is not restricted to the particular forms shown in the foregoing embodiments. Various modifications and alterations can be made thereto without departing from the scope of the invention encompassed by the appended claims.

What is claimed is:

1. An ink jet recording apparatus, comprising:

a recording head that records by ejecting ink onto a recording medium;

a head recovery device that recovers a function of the recording head;

a manually operated first switch that operates the head recovery device; and an inhibition device that inhibits operation of the head recovery device under a predetermined condition when the first switch is operated.

2. An ink jet recording apparatus according to claim 1, wherein the inhibition device comprises a second switch provided aside from the first switch, and wherein the inhibition device cancels the inhibition of operation of the head recovery device when the first switch and the second switch are operated.

3. An ink jet recording apparatus according to claim 1, wherein the inhibition device cancels the inhibition of operation of the head recovery device when the first switch is repeatedly operated.

4. An ink jet recording apparatus according to claim 1, wherein the inhibition device comprises a sensor that measures an amount of ink remaining in the recording apparatus, and the inhibition device prevents cancellation of the inhibition of operation of the head recovery device when the amount measured by the sensor is equal to or less than a predetermined amount.

5. An ink jet recording apparatus according to claim 1, wherein the inhibition device comprises a second counter that counts a number of operations of the recovery device, and the inhibition device prevents cancellation of the inhibition of operation of the head recovery device when the count by the second counter has reached a predetermined value.

6. An ink jet recording apparatus according to claim 1, further comprising a recovery permission device that forcibly cancels a condition set for the inhibition by the inhibition device.

7. An ink jet recording apparatus according to claim 1, further comprising an inhibition condition setting device that enables selection of whether to set a condition for the inhibition by the inhibition device.

8. An ink jet recording apparatus according to claim 1, wherein the ink jet recording apparatus is a small-size manually-driven printing apparatus that records by ejecting ink onto a recording medium when the apparatus is manually moved relative to the recording medium.

9. The ink jet recording apparatus according to claim 1, wherein the inhibition device cancels the inhibition of operation of the head recovery device at a predetermined value after a predetermined operation of the ink jet recording apparatus.

10. The ink jet recording apparatus according to claim 9, wherein the predetermined operation is an operation of the head recovery device.

11. An ink jet recording apparatus according to claim 10, wherein the inhibition device comprises a timer that measures elapsed time after a previous operation of the head recovery device, and the inhibition device cancels the inhibition of operation of the head recovery device when the time measured by the timer reaches the predetermined value.

12. An ink jet recording apparatus according to claim 10, wherein the inhibition device comprises a counter that counts an amount of printed characters that is performed by the recording head after a previous operation of the head recovery device, and the inhibition device cancels the inhibition of operation of the head recovery device when the count by the counter reaches the predetermined value.

13. An ink jet recording apparatus according to claim 10, wherein the inhibition device comprises a sensor that counts an amount of ink that is used by the recording head after a previous operation of the head recovery device, and the inhibition device cancels the inhibition of operation of the head recovery device when the count provided by the sensor reaches the predetermined value.

14. An ink jet recording apparatus according to claim 10, wherein the inhibition device comprises a counter that counts a number of times that the recording head prints after a previous operation of the head recovery device, and the inhibition device cancels the inhibition of operation of the head recovery device when the count by the counter reaches the predetermined value.

15. The ink jet recording apparatus according to claim 10, wherein the ink jet recording head records by ejecting ink onto a recording medium when the apparatus is manually moved relative to the recording medium.

16. The ink jet recording apparatus according to claim 15, further comprising a holding portion for holding by an operator, the first switch provided on the holding portion.

17. The ink jet recording apparatus according to claim 9, wherein the predetermined operation is an operation of turning on a main switch of the ink jet recording apparatus.

18. An ink jet recording apparatus according to claim 17, wherein the inhibition device comprises a timer that measures elapsed time after a main switch of the ink jet recording apparatus is turned on, and the inhibition device cancels the inhibition of operation of the head recovery device when the time measured by the timer reaches the predetermined value.

19. An ink jet recording apparatus according to claim 17, wherein the inhibition device comprises a counter that counts an amount of printed characters that is performed by the recording head after a main switch of the ink jet recording apparatus is turned on, and the inhibition device cancels the inhibition of operation of the head recovery device when the count by the counter reaches the predetermined value.

20. An ink jet recording apparatus according to claim 17, wherein the inhibition device comprises a counter that counts an amount of ink that is used by the recording head after a main switch of the ink jet recording apparatus is turned on, and the inhibition device cancels the inhibition of operation of the head recovery device when the count by the counter reaches the predetermined value.

21. An ink jet recording apparatus according to claim 17, wherein the inhibition device comprises a counter that counts a number of times that the recording head prints after a main switch of the ink jet recording apparatus is turned on, and the inhibition device cancels the inhibition of operation of the head recovery device when the count by the counter reaches the predetermined value.

22. An ink jet recording apparatus according to claim 9, wherein the inhibition device comprises a timer that measures elapsed time after a previous operation of the recording head, and the inhibition device cancels the inhibition of operation of the head recovery device when the time measured by the timer reaches the predetermined value.

23. The ink jet recording apparatus according to claim 22, wherein the ink jet recording head records by ejecting ink onto a recording medium when the apparatus is manually moved relative to the recording medium.

24. The ink jet recording apparatus according to claim 23, further comprising a holding portion for holding by an operator, the first switch provided on the holding portion.

25. A printing apparatus, comprising:

an ink ejection printhead having a plurality of ink ejection nozzles;

an ink cartridge fluidly connected to the ink ejection printhead;

a recovery mechanism that cleans the ink ejection nozzles;

a recovery inhibition device that inhibits operation of the recovery mechanism;

an inhibition override mechanism that overrides the recovery inhibition device;

a manually operated switch that must be activated to initiate recovery; and a printer body mounting the proceeding elements.

26. The ink jet recording apparatus according to claim 25, wherein the ink jet recording head records by ejecting ink onto a recording medium when the apparatus is manually moved relative to the recording medium.

27. The ink jet recording apparatus according to claim 26, further comprising a holding portion for holding by an operator, the manually operated switch provided on the holding portion.

28. The printing apparatus according to claim 27, wherein the inhibition override mechanism further comprises:

a print instruction switch that when turned on sequentially with the suction switch overrides the recovery inhibition mechanism.

29. The printing apparatus according to claim 27, wherein the inhibition override mechanism overrides the recovery inhibition mechanism at a predetermined value after a previous predetermined operation of the printing apparatus.

30. The printing apparatus according to claim 29, wherein the inhibition override mechanism comprises a timer and a judgment control, wherein the judgment control determines whether an elapsed time counted by the timer exceeds a predetermined time since a last recovery operation, the inhibition override mechanism overriding the recovery inhibition mechanism when the elapsed time exceeds the predetermined value.

31. The printing apparatus according to claim 29, further comprising a power switch, wherein the inhibition override mechanism comprises a timer and a judgment control, the judgment control determining whether an elapsed time counted by the timer exceeds a predetermined time since power was turned on, the inhibition override mechanism overriding the recovery inhibition mechanism when the elapsed time exceeds the predetermined value.

32. The printing apparatus according to claim 27, further comprising a plurality of memory areas and the inhibition override mechanism includes a judgment control for comparing a value stored in a memory area of the plurality of memory areas and an appropriate predetermined value stored in a data area, the inhibition override mechanism overriding the recover inhibition mechanism when the stored value equals or exceeds the appropriate predetermined value.

33. The printing apparatus according to claim 32, further comprising an amount of printed characters counting mechanism that counts characters printed, wherein the memory area is an amount of printed characters storage area, the stored value is a count of printed characters since a last recovery operation and the appropriate predetermined value is a predetermined number of characters.

34. The printing apparatus according to claim 32, further comprising:

an ink flow sensor, wherein the memory area is an ink consumption storage area, the stored value is an amount of ink consumed since a last recovery operation, and the appropriate predetermined value is a predetermined amount of ink consumption.

35. The printing apparatus according to claim 32, further comprising a print instruction switch and a switch counter, wherein the memory area is a number-of-prints storage area, the stored value is a count of the number of times the print instruction switch is turned on as counted by the switch counter since a last recovery operation, and the appropriate predetermined value is a predetermined switch on count.

36. The printing apparatus according to claim 32, further comprising:

a power switch; and a character counting mechanism counts characters printed, wherein the memory area is an amount of printed characters storage area, the stored value is a count of printed characters since power was turned on by the power switch, and the appropriate predetermined value is a predetermined number of print characters.

37. The printing apparatus according to claim 32, further comprising:

a power switch;

an ink flow sensor; and a remaining ink sensor, wherein the memory area is an ink consumption storage area, the stored value is an amount of ink consumed since power was turned on by the power switch, and the appropriate predetermined value is a predetermined amount of ink consumption.

38. The printer apparatus according to claim 32, further comprising:

a power switch;

a print instruction switch; and a switch counter, wherein the memory area is a number-of-prints storage area, the stored value is a count of the number of times the print instruction switch is turned on after the power switch is turned on as counted by the switch counter, and the appropriate predetermined value is a predetermined switch on count.

39. The print apparatus according to claim 27, further comprising:

a remaining ink amount sensor;

a data memory storing a predetermined remaining ink value; and a judgment control as a part of the inhibition override mechanism, wherein the judgment control prevents an override of the recovery inhibition mechanism when value output by the remaining ink amount sensor is less than or equal to the predetermined remaining ink value.

40. The printing apparatus according to claim 27, further comprising:

a cartridge replacement detection sensor;

a counter that counts recovery operations;

a data memory containing a predetermined value; and a number of recovery operations storage area, wherein the inhibition override mechanism includes a judgment control, the judgment control prohibiting override of the recovery inhibition mechanism when a count of recovery operations exceeds the predetermined value after a cartridge has been replaced.

41. The printing apparatus according to claim 27, further comprising a reset switch for overriding the recovery inhibition mechanism.

42. The printing apparatus according to claim 27, further comprising a recovery inhibition switch for activating the recovery inhibition mechanism.

43. A printing apparatus, comprising:

an ink ejection printhead having a plurality of ink ejection nozzles;

an ink cartridge fluidly connected to the ink ejection printhead;

a recovery mechanism that cleans the ink ejection nozzles;

a recovery inhibition device that inhibits operation of the recovery mechanism;

an inhibition override mechanism that overrides the recovery inhibition mechanism;

a manually operated switch that must be activated to initiate recovery;

a holding portion for holding by an operator, the manually operated switch provided on the holding portion; and a printer body mounting the proceeding elements, wherein the ink jet recording head records by ejecting ink onto a recording medium when the apparatus is moved relative to the recording medium.

* * * * *